US006023016A

United States Patent [19]

Tamura

[11] Patent Number: 6,023,016

[45] **Date of Patent: *Feb. 8, 2000**

[54] TONE GENERATOR SYSTEM USING COMPUTER SOFTWARE

[75] Inventor: Motoichi Tamura, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,232

[22] Filed: Jan. 16, 1997

[30] Foreign Application Priority Data

Jan. 17, 1996 [JP] Japan ..... 8-024748
Mar. 12, 1996 [JP] Japan ..... 8-083157

[51] Int. Cl.[7] ..... G10H 1/08; G10H 7/00
[52] U.S. Cl. ..... 84/604; 84/625; 84/645
[58] Field of Search ..... 84/601–607, 625, 84/645

[56] References Cited

U.S. PATENT DOCUMENTS

| | | | |
|---|---|---|---|
| 4,373,416 | 2/1983 | Endo et al. . | |
| 5,086,475 | 2/1992 | Kutaragi | 84/603 X |
| 5,121,667 | 6/1992 | Emery et al. . | |
| 5,200,564 | 4/1993 | Usami et al. . | |
| 5,283,386 | 2/1994 | Akutsu et al. . | |
| 5,319,151 | 6/1994 | Shiba et al. . | |
| 5,331,111 | 7/1994 | O'Connell | 84/602 |
| 5,448,009 | 9/1995 | Kudo . | |
| 5,508,469 | 4/1996 | Kunimoto et al. | 84/603 |
| 5,567,900 | 10/1996 | Higashi | 84/602 |
| 5,596,159 | 1/1997 | O'Connell | 84/645 X |
| 5,613,147 | 3/1997 | Okamura | 84/602 X |
| 5,614,685 | 3/1997 | Matsumoto et al. | 84/602 |
| 5,726,371 | 3/1998 | Shiba et al. . | |

FOREIGN PATENT DOCUMENTS

| | | |
|---|---|---|
| 0 484 047 | 5/1992 | European Pat. Off. . |
| 0 597 381 | 5/1994 | European Pat. Off. . |
| WO 80/01215 | 6/1980 | WIPO . |

OTHER PUBLICATIONS

"Digidesign Turbosynth: Synthesis and Sound Processing for the Apple Macintosh," Computer Music Journal, vol. 12, No. 3, Fall 1988, pp. 79–80.

"Accelerando: A Real–Time, General Purpose Computer Music System,"by Keith Lent, et al, Computer Music Journal, vol. 13, No. 4, Winter, 1989, pp. 54–64.

"Digidesign's Sound Accelerator: Lessons Lived and Learned," by Bill Lowe and Robert Currie, Computer Music Journal, vol. 13, No. 1, Spring 1989, pp. 36–46.

"Musical Applications of Microprocessors", Second Edition, by Hal Chamberlin, 1985, pp. 639–778.

*Primary Examiner*—Stanley J. Witkowski
*Attorney, Agent, or Firm*—Graham & James LLP

[57] ABSTRACT

MIDI performance information is received via an operating system (OS) and an application-level software tone generator is driven on the basis of the received MIDI performance information, so as to allow the software tone generator to have an increased range of simple applications on the OS level. To this end, a fake driver is installed in the OS, and performance information output from application software is received by the fake driver via the operating system and then sent to the application-level software tone generator. As another example, the software tone generator is installed as a driver in the operating system so that information output from application software can be received by the software tone generator via the operating system.

14 Claims, 17 Drawing Sheets

TONE GENERATOR SYSTEM USING COMPUTER SOFTWARE

BACKGROUND OF THE INVENTION

The present invention relates to a tone generator system which forms tone or sound waveform data by executing a sound waveform data forming program, using a general-purpose arithmetic processor such as a CPU or computer.

In many electronic musical instruments today, microprocessors are used to execute tone generating processing. In some cases, the microprocessors even execute such processing to impart effects to tone waveform sample data formed through the tone generating processing. It has long been common practice, in the art, to implement such microprocessors by dedicated hardware (for example, tone generator LSI or DSP) having a circuit structure depending on a particular tone generating method employed (for example, waveform memory or FM synthesis method).

However, thanks to the recent improvement of CPU's computing capability, electronic musical instruments have appeared where the CPU incorporated in a general-purpose computer or dedicated tone generating device is designed to execute a program describing predetermined steps of tone generating processing. Here, the tone generating device or method based on such a tone generating processing program will be called a "software tone generator", while the traditional tone generating device or method using the dedicated hardware will be called a "hardware tone generator".

The conventional software tone generators are arranged as application-level software. FIG. 22 illustrates an example configuration of software used for implementing such an application-level software tone generator. To minimize the programming complexity, this software is hierarchically organized as a composite of a plurality of minimum units (modules) that are programmable independently of each other. Specifically, programs on a highest level of the hierarchy are modules for creating MIDI messages which are in the form of application software such as sequencer software, game software and karaoke software.

In the illustrated example of FIG. 22, two forms of application software are provided, one of which is karaoke software installed in a karaoke player and the other of which is MIDI reproduction software installed in a MIDI player. The MIDI player prestores therein files of a multiplicity of karaoke music pieces in MIDI format, and it reads out one of the files for a selected one of the music pieces so as to output performance information of the selected music piece in MIDI message format. A software tone generator module is provided on a level following the karaoke software and includes, on its input side, a predetermined application programming interface ("API") for software tone generator. In the example of FIG. 22, the application programming interface (API) for software tone generator is shown as "SGM MIDI out API".

The software tone generator module comprises a program for forming tone waveform data on the basis of a MIDI message supplied via a dedicated software tone generator API such as the interface "SGM MIDI out API". As shown in FIG. 23, the software tone generator module includes a MIDI output driver section and a tone generator (or engine) section. The MIDI output driver section is a module for driving the tone generator section, which is responsive to the MIDI message to convert voice data into control parameters to control the tone generator section. The control parameters are sent to the tone generator section via predetermined inter-module interfaces (not shown). As the MIDI output driver section is initialized, a group of necessary waveform data are loaded from a given file and stored in a waveform data storage section. Using the group of waveform data and in accordance with the control parameters, the tone generator section generates tone waveform sample data (i.e., tone waveform data at successive sample points) of given musical characteristics such as pitch and tone color.

In a predetermined operating system (OS), such as Windows3.1 or Windows95 (trademark of Microsoft Corporation) employed in the computer, there is provided an interface for receiving and delivering formed waveform sample data (this interface may be "WAVE out API" in the case of Windows3.1). The output device is a driver module installed in the operating system (OS), which receives, via a predetermined interface such as the "WAVE out API", waveform sample data formed by the software tone generator module provided as application software and then outputs the formed sample data to external hardware. For example, the output device comprises software which, via a direct memory access (DMA) controller, reads out waveform sample data formed through processing by the software tone module and stored in a storage device such as a hard disk and then outputs the read-out sample data to the external hardware such as a digital/analog converter (DAC).

The MIDI player shown in FIG. 22 is of a type which has MIDI reproduction and software tone generator modules previously installed therein. The MIDI reproduction module reads out a standard MIDI file (SMF) so as to reproduce MIDI messages. Each of the reproduced MIDI messages is processed by the software tone generator module so as to form tone waveform sample data corresponding to the MIDI message in a similar manner to the above-mentioned. The tone waveform sample data thus formed by the software tone generator module in the MIDI player is sent via a predetermined interface such as the "WAVE out API" to the output device for further processing and then output to the external hardware such as the digital/analog converter (DAC).

In the computer operating system, there is also provided an interface for receiving and delivering performance information (typically, MIDI message) on the basis of which waveform sample data is to be formed (this interface may be "MIDI API" in the case where Windows3.1 is employed). With such an interface, software that outputs a MIDI message can be used as application software, as shown by way of example in FIG. 24. In the example of FIG. 24, game software, game software, multimedia software, etc. are provided, so that various game effect sounds, background music sounds, MIDI data or performance information of automatic sequence performance sounds can be output from these software in the form of MIDI messages. Each of such MIDI messages is received by the operating system (OS) via a predetermined interface such as the "MIDI API" and then passed to a MIDI driver. The MIDI driver supplies an external hardware tone generator with tone forming data based on the passed MIDI message, and the external hardware tone generator, in turn, forms tone waveform sample data on the basis of the tone forming data using a predetermined tone generating hardware device.

However, the conventionally-known application-level software tone generators as mentioned above are unable to receive data from the interface (such as the MIDI API) for receiving and delivering performance information to execute waveform sample data forming processing on the basis of the received data, although they can output formed waveform sample data to a predetermined interface (such as the WAVE out API) of the operating system.

Thus, in the past, it was impossible to simply combine the performance information (MIDI message) generating software, such as game software, sequencer software or multimedia software, with the application-level software tone generator via the computer operating system. Therefore, in order to allow such performance information (MIDI message) generating software to be applied to the computer operating system and simply used therewith, an expensive hardware tone generator was absolutely needed.

In cases where the tone generating processing is executed on the basis of performance information such as a MIDI message, it is quite rare for the computer to execute the tone generating processing alone; mostly, the computer runs one or more other software programs concurrently or in parallel with the tone generating processing under the control of the same operating system. For example, when running game software, it may be necessary for the computer to execute other processing, such as for generating animated pictures, in parallel with sound generating processing, or when running karaoke software, it may be necessary for the computer to execute processing for generating a visual display of words of a song or background images. If a software tone generator is used, the computer executes the software tone generator program and other necessary software program in a parallel fashion under the control of the same OS. In such a case, in order to assure that the tone waveform sample data forming processing be executed by the software tone generator without being influenced by the other processing, it is desirable to execute the tone generating processing on an operating system having a full multitask function (such as Windows95).

However, in fact, operating systems not having a full multitask function (such as Windows3.1) have also been widely used today, and there exists an increasing need to execute the tone generating processing on such operating systems not having a full multitask function. With the operating systems not having a full multitask function, generation of tones may be hindered by the execution of the tone generating processing being delayed due to the other processing, or execution of the other processing may be delayed by the tone generating processing taking too much time. In particular, if a software tone generator is applied to application software that was used with a hardware tone generator alone and hence did not present the above-discussed problems associated with the parallel processing, it is desirable to previously consider appropriate means or counterplans to obviate the problems that could arise from the parallel processing by the computer.

SUMMARY OF THE INVENTION

It is therefore an object of the present invention to provide a tone generator system using computer software which is capable of receiving performance information, such as a MIDI message, via an operating system to drive an application-level software tone generator and thereby increasing a range of applications of the software tone generator.

It is another object of the present invention to provide a tone generator system using computer software which permits appropriate execution of tone generating processing and other processing without any hindrance thereto even when the two processing is executed on an operating system that does not have a full multimedia function.

In order to achieve the above-mentioned object, a first aspect of the present invention provides a tone generator system for forming sound waveform data by use of a computer having installed therein a predetermined operating system and a program for implementing a software tone generator. In the tone generator system, the operating system includes a first interface for receiving performance information on the basis of which waveform data is to be formed and delivering the received performance information to a program installed as a driver in the operating system, and a second interface for receiving formed waveform data and delivering the received formed waveform data to a waveform outputting program installed as a driver in the operating system. The software tone generator is application-level software which executes sound waveform data forming processing to form waveform data on the basis of the performance information and outputs the formed waveform data via the second interface. The tone generator system comprises a fake driver which is installed as a driver in the operating system and programmed to receive the performance information delivered via the first interface and send the received performance information to the software tone generator.

According to the first aspect of the invention, performance information (e.g., MIDI message) supplied from other application software via the first interface can be received by the fake driver and then delivered to the software tone generator. Thus, the software tone generator, which is itself application software, is allowed to receive the performance information supplied from the other application software and then execute the waveform forming processing on the basis of the received performance information. Consequently, the software tone generator can be readily combined with other application software on the OS level and can receive performance information (e.g., MIDI message) supplied via the first interface from the other application software to thereby form sound waveform data corresponding to the performance information. With such an arrangement, it is possible to increase a range of applications of the software tone generator which is itself application software, and also eliminate the need for a hardware tone generator in a case where desired application software, such as game software, sequencer software or multimedia software, generating performance information (e.g., MIDI message) is to be applied to the operating system of the computer for simple use therewith. As a result, the present invention achieves reduced cost while assuring an increased range of simple applications of the software tone generator.

In a preferred embodiment, the tone generator system may further comprise a first section for supplying performance information to the first interface (this section may be the above-mentioned other application software that generates performance information such as a MIDI message) and a second section for sending performance information to the software tone generator (this section may be optional software, such as karaoke software incorporated in the software tone generator for exclusive use thereby without an intervention of the operating system, as commonly known in the art). The software tone generator may execute both sound waveform data forming processing on the basis of the performance information supplied from the first section via the first interface and sound waveform data forming processing on the basis of the performance information supplied directly from the second section. With such an arrangement, it is possible to share the software tone generator between the software incorporated in the software tone generator for exclusive use thereby (i.e., the second means) and the other software combined via the operating system with the software tone generator (i.e., the first means).

A second aspect of the present invention provides a tone generator system for forming tone sound waveform data by use of a computer having installed therein a predetermined operating system and a program for implementing a software tone generator. In the tone generator system, the operating system includes a first interface for receiving performance information on the basis of which waveform data is to be formed and delivering the received performance information to a program installed as a driver in the operating system, and a second interface for receiving formed waveform data and delivering the received formed waveform data to a waveform outputting program installed as a driver in the operating system. The software tone generator is application-level software which executes sound waveform data forming processing to form waveform data on the basis of the performance information and outputs the formed waveform data via the second interface. The program implementing a software tone generator is installed, as a driver, in the operating system and designed in such a manner that the software tone generator receives the performance information delivered via the first interface and executes waveform forming processing on the basis of the performance information received via the first interface.

According to the second aspect of the present invention, the software tone generator, which is itself application software, is installed as a driver in the operating system and programmed to receive the performance information supplied via the first interface. Thus, performance information (e.g., MIDI message) supplied from other application software via the first interface can be received by the software tone generator via the operating system. With this arrangement as well, the software tone generator, which is itself application software, is allowed to receive the performance information supplied from the other application software and execute the sound waveform data forming processing on the basis of the received performance information, and generally the same benefits as mentioned in relation to the first aspect can be attained.

According to a third aspect of the present invention, the computer of the tone generator system includes a main control section for executing the program implementing the software tone generator and another program in a parallel fashion, and the main control section includes a section for generating an activating instruction at one or more of a plurality of predetermined points within a predetermined time period when the program implementing the software tone generator may be actually executed. The tone generator system further comprises an adjusting section for adjusting the sound waveform data forming processing in such a manner that a predetermined number of samples of sound waveform data can be formed in total by just the sound waveform data forming processing being executed in response to the activating instruction actually generated at one or more of the predetermined points.

A plurality of predetermined points for activating the sound waveform data forming processing are set within a predetermined period, and the activating instruction is generated at one or more of the predetermined points when the program implementing the software tone generator may be actually executed. With such an arrangement, the main control section is allowed to generate the activating instruction at one or more of the predetermined points when the program implementing the software tone generator may be actually executed in proper trade-off with current execution states of another program, so that the program implementing the software tone generator and the other program can be executed in a parallel fashion under proper time divisional control.

The adjusting section in the software tone generator adjusts the sound waveform data forming processing in such a manner that the predetermined number of samples of sound waveform data can be formed in total by just the sound waveform data forming processing being executed in response to the activating instruction actually generated at one or more of the predetermined points. Thus, even when the activating instruction fails to be generated at some of the predetermined points within the period, appropriate control can be made such that the predetermined number of samples of sound waveform data are formed in total by just the sound waveform data forming processing being actually executed in response to the activating instruction actually generated at one or more of the predetermined points. Namely, the quantity of sound waveform data to be formed by the software tone generator per activating instruction is variably controlled, so that even if the number of activating instructions generated within the predetermined period is varied depending on the situations of the main control section, appropriate control can be reliably made such that formation of the predetermined number of samples of sound waveform data can be completed in total.

Therefore, the present invention achieves the benefit that the sound waveform data forming processing and processing based on other software can be executed without any trouble even in the case where these processing is executed in a parallel fashion by the same software tone generator under the control of an operating system not having a full multitask function. Thus, even when the number of activating instructions generated to activate the sound waveform data forming processing is undesirably reduced due to an influence of the processing based on the other software, appropriate control can be reliably made such that the predetermined number of samples of sound waveform data are formed completely in total, and thereby unwanted inconveniences, such as time delays in tone generation, are effectively prevented. Because the sound waveform data forming processing is not executed in fixed time divisions, it is possible to avoid the problem that the processing based on the other software is hindered and delayed by the sound waveform data forming processing.

In a preferred embodiment, the adjusting section may be arranged in such a manner that at each of the points corresponding to the actually generated activating instruction, it determines a quantity of sound waveform data to be formed in response to the activating instruction as a function of a "left-unformed" quantity of sound waveform data that should have been formed up to the point. In this case, the software tone generator is designed to form the determined quantity of sound waveform data in response to the activating instruction. Thus, by appropriately determining the above-mentioned function, an appropriate number of sound waveform data to be formed per activating instruction can be determined in proper trade-off with the left-unformed quantity of sound waveform data that should have been formed. As a result, appropriate control can be reliably made to minimize the possibility that the other processing is hindered by the main control section being occupied by the processing in the software tone generator per activating instruction.

A fourth aspect of the present invention provides a tone generator system for forming sound waveform data by executing a sound program operating under the control of a predetermined operating system. The operating system includes a first interface for receiving performance information on the basis of which waveform data is to be formed and delivering the received performance information to a program installed as a driver in the operating system, a second interface for receiving formed waveform data and delivering the received formed waveform data to a waveform outputting program installed as a driver in the operating system, and a third interface for receiving the formed waveform data and delivering the received formed waveform data to a program installed as a driver in the operating system. The sound program is installed as a driver in the operating system, and the sound program executes a forming step of executing tone generating processing to form sound waveform data on the basis of the performance information received via the first interface, a mixing step of mixing, in a synchronized fashion, the sound waveform data received via the third interface and the sound waveform data formed by the forming step, and an outputting step of outputting to the second interface the sound waveform data mixed by the mixing step.

In the tone generator system according to the above-mentioned second aspect of the present invention, the second interface for receiving and delivering formed sound waveform data is occupied by the software tone generator, so that sound waveform data generated by other application software can not be output to the first interface. In contrast, according to the fourth aspect of the present invention, the operating system includes, as an interface for receiving and delivering formed sound waveform data, the third interface, in addition to the second interface. The addition of the third interface allows sound waveform data from other application software to be received by the third interface when the second interface is occupied by the software tone generator.

As discussed earlier as the problem posed by the conventionally-known technique, the tone generating processing based on performance information is undesirably hindered by processing based on other software that needs to be executed in parallel with the tone generating processing. Thus, the time when sound waveform data forming operations are completed in the software tone generator on the basis of performance information received from other application software via the first interface would be delayed behind the time when sound waveform data generated from other application software at the same timing as the generation of the performance information is output to the third interface. Therefore, if these sound waveform data are supplied to the operating system with the timing unadjusted, then there would occur appreciable differences in reproduction timing, causing significant inconveniences in music performance.

The fourth aspect of the present provides a solution to this problem. Namely, the sound program, which is application software installed as a driver in the operating system, forms sound waveform data on the basis of the performance information received via the first interface, mixes the formed sound waveform data with the sound waveform data received via the third interface in a synchronized fashion, and outputs the resultant mixed sound waveform data to the second interface. By thus mixing the sound waveform data formed on the basis of the performance information with the sound waveform data received via the third interface in a synchronized fashion and then outputting the mixed sound waveform data to the second interface, the time delay in the sound waveform data formation can be appropriately adjusted for proper matching of the reproduction timing.

In a preferred embodiment of the fourth aspect, the mixing step may accumulatively add the sound waveform data formed by the forming step to the sound waveform data received via the third interface, so as to mix the sound waveform data. Because, mixing the sound waveform data received via the third interface with the sound waveform data based on the performance information is very difficult due to the fact that the timing to form sound waveform data on the basis of the performance information varies depending on other software being executed in parallel with the sound waveform data formation. Thus, in the preferred embodiment, the sound waveform data received via the third interface is supplied as an initial value prior to the sound waveform data formation so that the sound waveform data can be mixed together in a synchronized fashion without being influenced by the sound waveform data formation based on the performance information. As a result, stable reproduction of the sound waveform data can be effected at appropriately matched timing.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
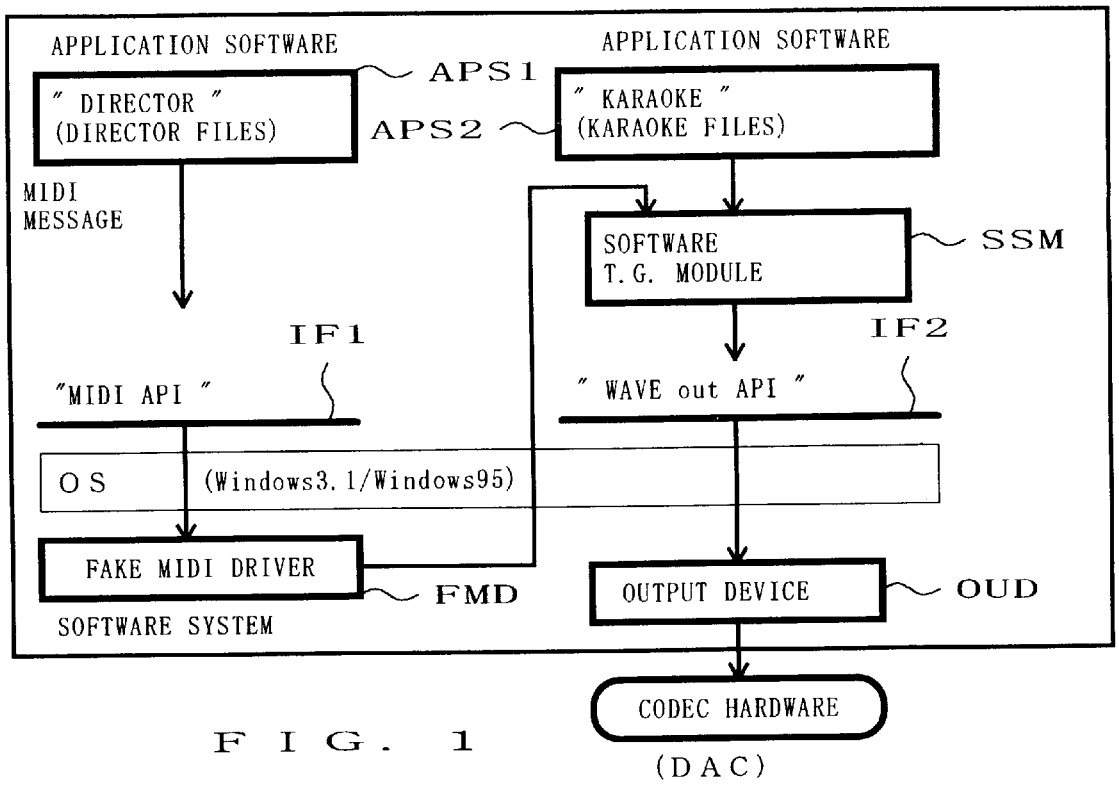
FIG. 1 is a conceptual block diagram illustrating a general structure of a software system in accordance with an embodiment of the present invention.

FIG. 1 is a conceptual block diagram illustrating a general structure of a software system in accordance with one aspect of the present invention.

The software system employs, as an operating system (OS), Windows3.1 or Windows95 (both trademarks of Microsoft Corporation). This operating system (OS) includes a "MIDI API" as a first interface IF1 for receiving and delivering a MIDI message (i.e., performance information on the basis of which waveform data is to be formed), and a "WAVE out API" as a second interface IF2 for receiving and delivering formed waveform data.

For example, "Director" software is employed here as application software APS1 for generating a MIDI message (i.e., performance information on the basis of which waveform data is to be formed). This "Director" software includes "Director files" and outputs performance information of background music (BGM) in the form of a MIDI message. Of course, any other application software than the "Director" software may be employed, as long as it is designed to output MIDI messages.

A software tone generator (T.G.) module SSM is application-level software, which includes a dedicated interface, such as a "SGM MIDI out API", for receiving a MIDI message, and forms tone or sound waveform data on the basis of the received MIDI message so as to output the resultant formed waveform data via the second interface IF2 (i.e., "WAVE out API"). This software tone generator module SSM may be arranged, for example, in a manner as previously shown in FIG. 23 in connection with the conventionally-known technique.

In the illustrated example of FIG. 1, a fake MIDI driver FMD is provided as a false driver that is programmed to receive the MIDI message supplied from the application software APS1 through the first OS interface IF1 and pass the received MIDI message to the software tone generator module SSM. This fake MIDI driver FMD is installed in the operating system as a driver. Thus, the MIDI message supplied from the application software APS1 via the first interface IF1 ("MIDI API") is received by the fake MIDI driver FMD and then transferred to the software tone generator module SSM.

The software tone generator module SSM receives the MIDI message from the fake MIDI driver FMD via its own interface (e.g., "SGM MIDI out API"), and forms waveform data on the basis of the received MIDI message so as to provide the OS with the resultant formed waveform data via the second interface IF2 (i.e., "WAVE out API") as previously noted.

In this way, the software tone generator module SSM, which is itself application software, is allowed to receive the MIDI message supplied from other application software APS1 via the "MIDI API" interface of the OS and execute sound waveform data forming processing on the basis of the received MIDI message. Therefore, the software tone generator module SSM that is itself application software can be readily combined with other application software APS1 on the OS level.

The software tone generator module SSM may contain suitable dedicated software for generating or supplying MIDI messages, as with the conventional software tone generator module. Application software (e.g., "Karaoke" software) APS2 shown in FIG. 1 is an example of such MIDI supplying software. The software tone generator module SSM also receives the MIDI message from the dedicated software APS2 via its own interface (e.g., "SGM MIDI out API") and executes sound waveform data forming processing on the basis of the received MIDI message so as to supply the OS with the resultant formed waveform data via the second interface IF2 ("WAVE out API"). In this way, the software tone generator module SSM can be shared between the software APS2 incorporated for exclusive use by the module SSM and other software APS1 combined with the module SSM via the OS.

The formed waveform data received by the OS via the second interface IF2 ("WAVE out API") is supplied via an output device OUD to an external device such as CODEC hardware (i.e., digital-to-analog converter (DA or DAC)).

Figure 2:
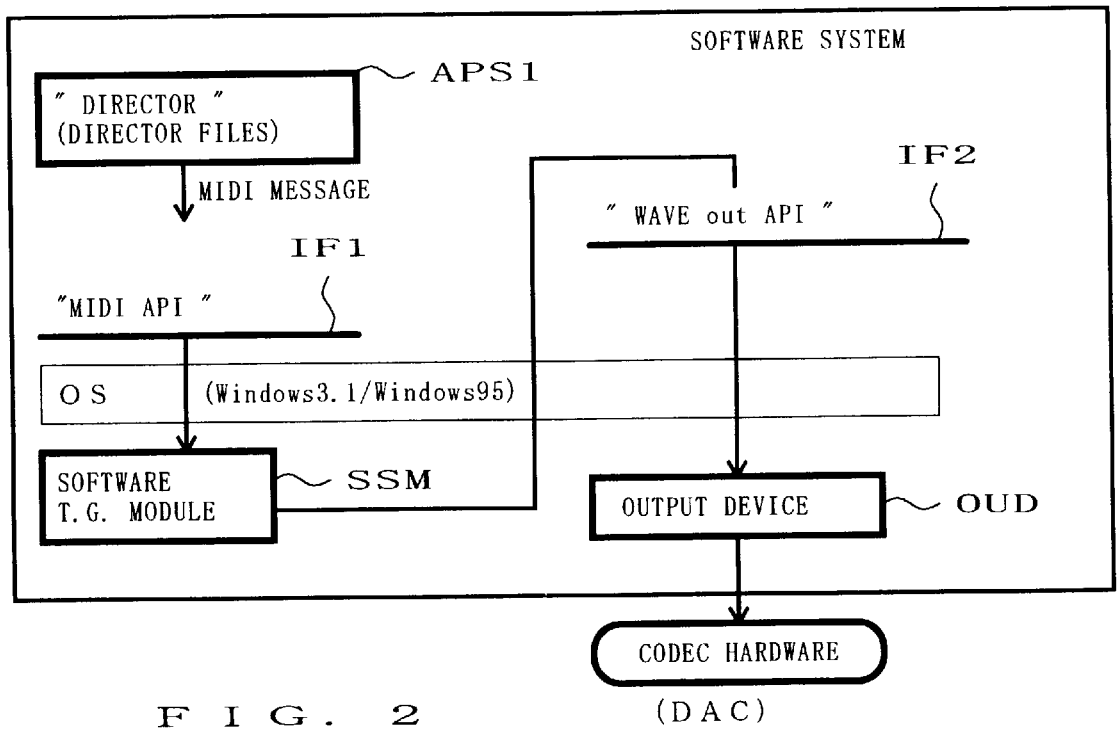
FIG. 2 is a conceptual block diagram illustrating a general structure of a software system in accordance with another embodiment of the present invention.

FIG. 2 is a conceptual block diagram illustrating a general structure of a software system in accordance with another embodiment of the present invention.

In FIG. 2, a software tone generator module SSM, which is itself application software, is installed as a driver in an operating system and programmed to receive a MIDI message supplied via a first interface IF1 ("MIDI API") of the operating system. Thus, a MIDI message can be supplied from application software APS1, via the first interface IF1 ("MIDI API") and the operating system, to the software tone generator module SSM. The software tone generator module SSM forms waveform sample data on the basis of the received MIDI message and supplies the resultant formed waveform sample data to the OS via a second interface IF2 ("WAVE out API"). Thus, in this case as well, the software tone generator module SSM, which is itself application software, is capable of receiving the MIDI message supplied from other application software APS1 on the OS level, and executing sound waveform data forming processing on the basis of the received MIDI message so as to output the formed waveform data via the second interface IF2 ("WAVE out API") on the OS level.

Figure 25:
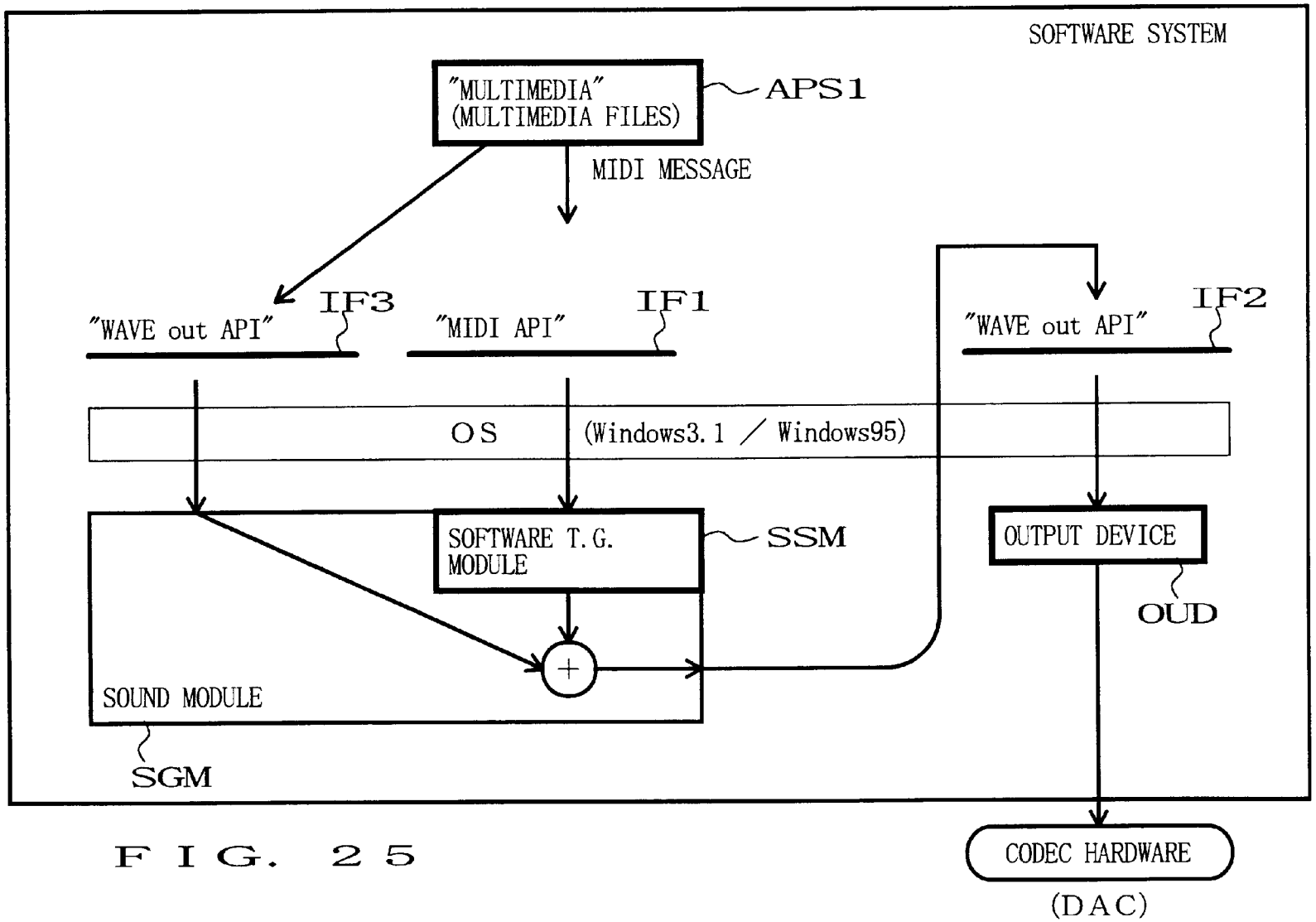
FIG. 25 is a conceptual block diagram illustrating a general configuration of a software system in accordance with still another embodiment of the present invention.

FIG. 25 is a conceptual block diagram illustrating a general structure of a software system in accordance with another embodiment of the present invention.

In FIG. 25, software "Multimedia" is provided as application software APS1 which generates a MIDI message and waveform data in a synchronized fashion. In addition to an interface IF2 ("WAVE out API") as shown in FIG. 2, an operating system (OS) includes a third interface IF3 ("WAVE out API" on the left in FIG. 25) provided by a sound module SGM which is application software installed as a driver in the OS. Each waveform data generated from the application software APS1 is received via the third interface IF3 provided by the sound module SGM.

The sound module SGM contains a software tone source module SSM, which, in a similar manner to the counterpart SSM of the system shown in FIG. 2, is programmed to receive the MIDI message from the application software APS1 via the first interface IF1 ("MIDI API") and forms waveform sample data on the basis of the received MIDI message.

Further, the sound module SGM is programmed to receive both the waveform data supplied from the application software APS1 via the interface IF3 and the waveform sample data formed by the software tone source module SSM and add together these received data so as to output the resultant added data to the second interface IF2. Thus, in this case as well, the sound module SGM, which is itself application software, is capable of receiving the MIDI message supplied from other application software APS1 on the OS level, executing sound waveform data forming processing on the basis of the received MIDI message, and adding together the formed waveform data and the waveform data supplied from the application software APS1 via the interface IF3 so as to output the added result on the OS level via the second interface IF2.

Figure 3:
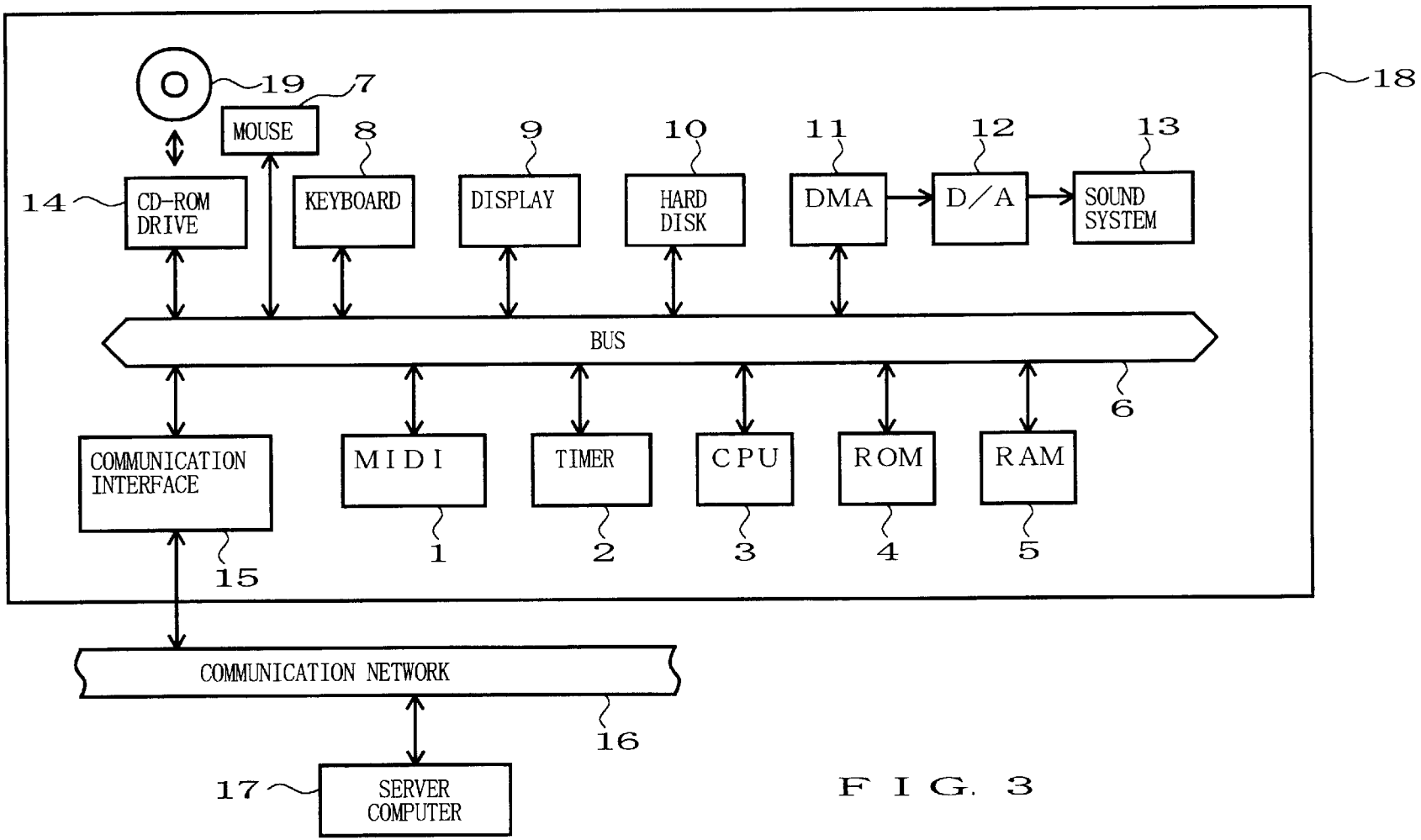
FIG. 3 is a block diagram illustrating a general hardware structure of a tone generator system using computer software in accordance with an embodiment of the present invention.

FIG. 3 is a block diagram illustrating a general hardware structure which is used to implement the tone generator system using computer software in accordance with the present invention.

The tone generator system of FIG. 3 employs a CPU (central processing unit) 3 of a personal computer as a main control section, and executes waveform sample data forming processing based on a program implementing a software tone generator program (i.e., software tone generator program) and other processing based on one or more other programs in a parallel fashion under the control of the CPU 3. The term "tone generating processing" used in the following description may be understood as having substantially the same meaning as the term "waveform sample data forming processing" used above, except that the term "tone generating processing" may also refer to an effect imparting operation and various sorts of tone processing operations other than the waveform sample data forming processing.

To the CPU 3 are connected, via a data and address bus 6, a MIDI interface 1, a timer 2, a ROM (read-only memory) 4, a RAM (random-access memory) 5, a mouse 7, a keyboard 8, a display 9, a hard disk device 10 and a DMA (direct memory access) controller 11.

The DMA controller 11 executes a predetermined reproduction process, in which it uses the known direct memory access method to sequentially read out, from an output buffer area of the RAM 5, tone data formed by the CPU 3 executing tone generating processing and then sends the read-out tone data to a D/A (DAC: digital-to-analog) converter 12, sample by sample, in synchronism with reproduction sampling clock pulses from the converter 12. Each of the tone data converted via the D/A converter 12 into analog representation is audibly reproduced or sounded via a sound system 13 comprised of amplifiers and speakers.

The hard disk device 10 has prestored thereon various software such as an OS (in this embodiment, Windows 3.1 (Microsoft's trademark)), utility software and software for implementing a software tone generator (i.e., the software tone generator module SSM of FIG. 1 or 2), as well as other application software (i.e., the application software ASP1 and ASP2 of FIG. 1 or 2). The hard disk device 10 includes a waveform data memory in which are prestored groups of waveform data of a plurality of tone colors for one or more periods. Various programs, such as the fake MIDI driver, may be stored in the hard disk device 10 or in the RAM 5 or ROM 4. In the following description, in order to clearly distinguish between the waveform data prestored in the waveform data memory of the hard disk device 10 and waveform sample data formed by the software tone generator module SSM in response to a MIDI message and using the prestored waveform data, the latter will also be referred to as "tone data".

The programs to be executed by the CPU 3 may be prestored in the ROM 4 rather than on the hard disk 10, there may be stored various other data than the waveform data. By loading any of the programs from the hard disk 10 or ROM 4 into the RAM 5, the CPU 3 can execute the program. This greatly facilitates version-up, addition, etc. of an operating program. A CD-ROM (compact disk) 19 may be used as a removably-attachable external recording medium for recording various data and an optional operating program. Such an operating program and data stored in the CD-ROM 19 can be read out by means of a CD-ROM drive 14 to be then transferred for storage on the hard disk 10. This facilitates installation and version-up of the operating program. The removably-attachable external recording medium may be other than the CD-ROM, such as a floppy disk and magneto optical disk (MO).

A communication interface 15 may be connected to the bus 6 so that the tone generator system 18 can be connected via the interface 15 to a communication network 16 such as a LAN (local area network), internet and telephone line network and can also be connected to an appropriate sever computer 17 via the communication network 16. Thus, where the operating program and various data are not stored on the hard disk 10, these operating program and data can be received from the server computer 17 and downloaded onto the hard disk 10. In such a case, the tone generator system 18, i.e., a "client", sends a command requesting the server computer 17 to download the operating program and various data by way of the communication interface 15 and communication network 16. In response to the command from the tone generator system 18, the server computer 17 delivers the requested operating program and data to the system 18 via the communication network 16. The tone generator system 18 completes the necessary downloading by receiving the operating program and data via the communication network 15 and storing these onto the hard disk 10.

It should be understood here that the tone generator system 18 of the present invention may be implemented by installing the operating program and various data corresponding to the operations of the present invention in a commercially available personal computer. In such a case, the operating program and various data corresponding to the operations of the present invention may be provided to users in a recorded form in a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Figure 23:
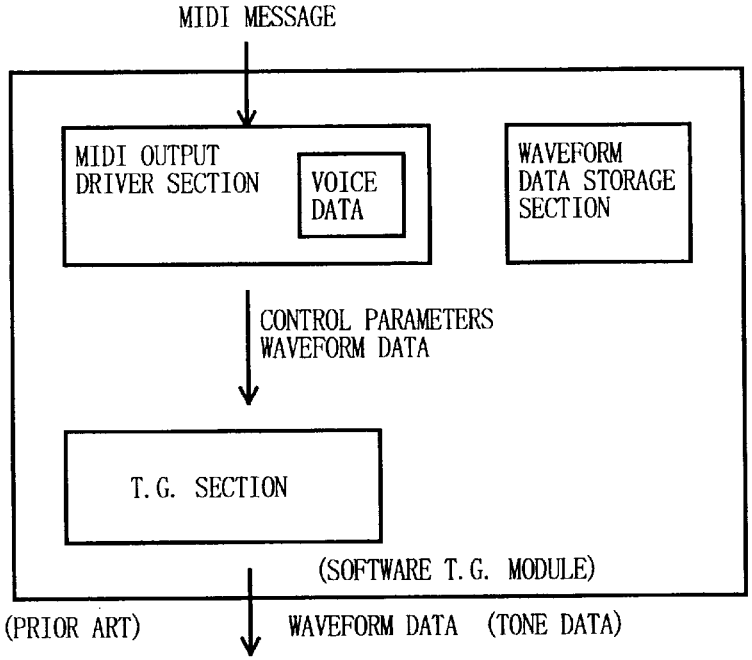
FIG. 23 is a conceptual block diagram illustrating an exemplary configuration of a conventionally-known software tone generator.

The software tone generator module SSM may be constructed generally in the manner as shown in FIG. 23. That is, as shown in FIG. 23, the software tone generator module SSM includes a MIDI output driver section and a tone generator section. The MIDI output driver section is a module for driving the tone generator section, which is responsive to a MIDI message to convert voice data into control parameters to control the tone generator section. The control parameters are sent to the tone generator section via predetermined inter-module interfaces (e.g., "SGM engine API"). When the MIDI output driver section is initialized, a group of necessary waveform data are loaded in from a given file in the waveform data memory and stored into a waveform data storage section. Using the group of waveform data and in accordance with the control parameters, the tone generator section generates tone waveform sample data or tone data of given musical characteristics such as pitch and tone color.

The output devices shown in FIGS. 1 and 2 are modules which supply the D/A converter 12 with the tone data sent from the software tone generator module SSM via the second OS-level interface ("WAVE out API"). The tone data is supplied to the D/A converter 12 by means of the DMA controller 11 in accordance with the known direct memory access method. Thus, the output devices are implemented by interrupt signals from the DMA controller 11 under the control of the CPU 3.

Figure 4:
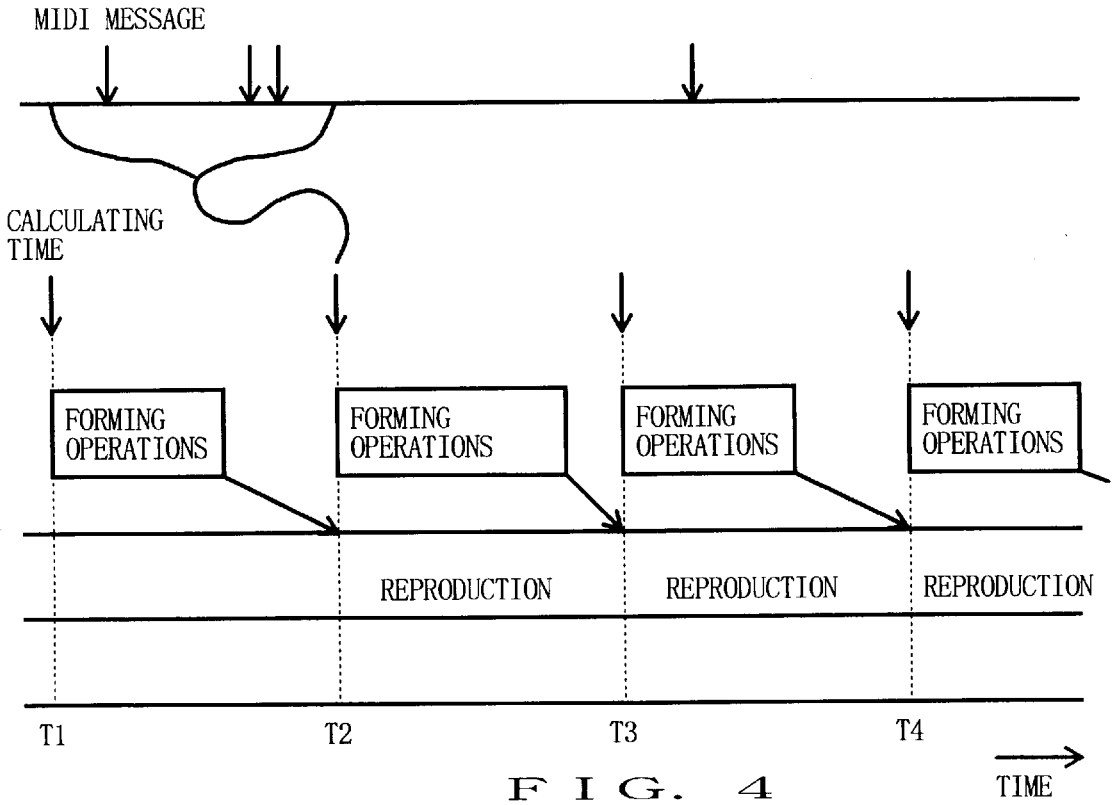
FIG. 4 is a diagram outlining tone generating processing based on software employed in the present invention.
Figure 24:
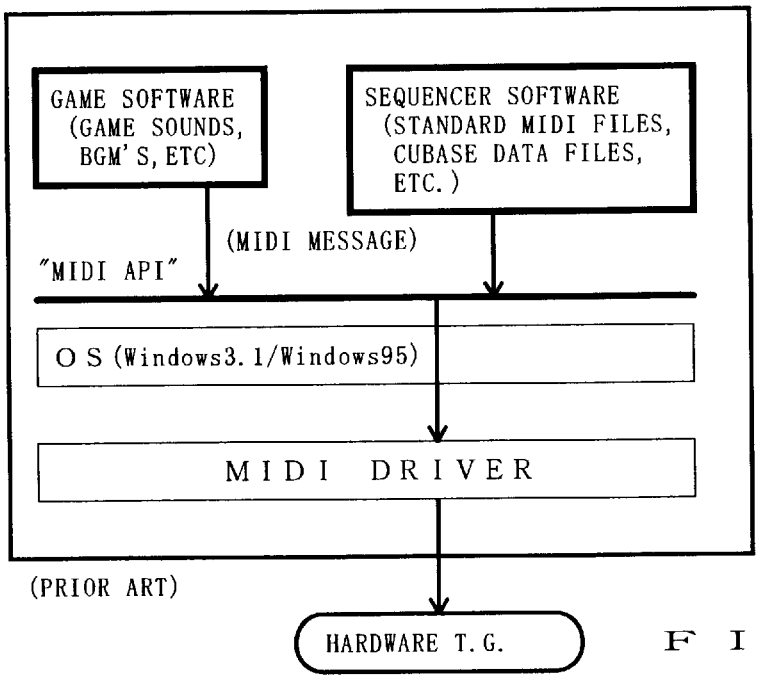
FIG. 24 is a block diagram illustrating an example of a conventionally-known system configuration that implements application software for generating MIDI messages.

Now, with reference to FIG. 4, a brief description will be made about an example of the tone generating processing that is executed by the software tone generator module SSM under the control of the CPU 3.

Upon activation of the program of the application software APS1 or APS2, supply of MIDI messages to the software tone generator module SSM is started. In the system of FIG. 1, each MIDI message output from the application software APS1 is supplied to the input interface ("SGM MIDI out API") via the first interface IF1 ("MIDI API") and fake MIDI driver FMD, while each MIDI message output from the application software APS2 is supplied directly to the input interface ("SGM MIDI out API"), as previously noted. Once the MIDI message is supplied to the input interface ("SGM MIDI out API") of the software tone generator module SSM, the MIDI output driver section of the module SSM (FIG. 23) is activated to convert voice data into control parameters and store the converted control parameters and other data into a tone generator register for one of tone generating channels assigned to tone generation based on the MIDI message. In other words, the tone generator registers for the tone generating channels constitute part of the input interface ("SGM MIDI out API") of the software tone generator module SSM.

Basically, the tone generator section of the module SSM (FIG. 23) is activated, every predetermined time period of predetermined length (hereinafter referred to as a "frame"), to execute the tone generating processing based on MIDI messages supplied within a preceding frame in accordance with the control parameters. In the example of FIG. 4, the tone generating processing based on MIDI messages supplied within the frame from time T1 to time T2 is executed within the next frame from time T2 to time T3. In a preferred example of the tone generating processing based on the waveform memory method, for each tone generating channel assigned to tone generation, waveform data are read out from the RAM 5 at a rate as dictated by the control parameters stored in the tone generator register for that channel, and the read-out waveform data are subjected to color control (filtering arithmetic operation), volume control (multiplication by tone volume envelope data) and modulation control of pitch, color, volume, etc. in accordance with the control parameters. In this manner, a predetermined number of samples of tone data are formed for the tone generating channel. The formed tone data of the assigned tone generating channels are accumulated and then written into the output buffer of the RAM 5. In some cases, the accumulated tone data may be imparted effects before being written into the output buffer. Then, reproduction of the tone data from the output buffer is reserved in the output device. Thus reserving reproduction of the tone data in the output device corresponds to outputting the formed tone data from the software tone generator module SSM to the second OS-level interface ("WAVE out API").

For each of the frames, the output device reads out the formed tone data, sample by sample, from the output buffer reserved by the tone generator section in the preceding frame and sends the read-out tone data to the D/A converter 12. In the example of FIG. 4, tone data formed within the frame from time T2 to time T3 are read out from the reserved output buffer in the frame from time T3 to time T4.

In the above-mentioned software, activation of the application software APS1 and/or APS2 and activation of the MIDI output driver section based on the supplied MIDI message are effected on a real-time time. The output device is activated compulsorily by an interrupt signal from the DMA controller 11, so that no time delay would result. In contrast, the tone generator section is activated by an internal interrupt signal from the CPU 3 itself; thus, when the software is run on an operating system (OS) with no full multitask function, the activation of the tone generator section would be delayed by an influence of other processing, so that desired tone generation could be hindered significantly. For this reason, the tone generator system of the present invention is constructed to effectively preclude such a hindrance to the tone generation, by taking some measures as will be outlined below.

<Measure 1>

According to this measure, a time point to generate an internal interrupt signal activating the tone generator section (i.e., activating or triggering instruction) is set to occur a plurality of times within each frame, so that the internal interrupt signal is actually generated only when the tone generating processing is permitted to be actually executed in the software tone generator. The timing may be set to occur periodically by use of the timer. By forming some of a "predetermined number of samples of tone data to be written in one output buffer" each time the tone generator section is activated by the signal, appropriate adjustment is made such that the "predetermined number of tone data to be written in one output buffer" can be belatedly formed in total within the frame in a distributed manner.

In the event that the tone generator section fails to be activated due to a failure of generation of the internal interrupt signal (i.e., activating instruction) at some of the points, appropriate adjustment can be made such that arithmetic formation of tone data to be written in one output buffer are effected, by forming the left-unformed tone data (i.e., tone data that failed to be formed at predetermined activating time) only when the internal interrupt signal or activating instruction is generated at one or more of the subsequent points within the frame.

According to Measure 1, the above-mentioned hindrance to the tone generation can be effectively avoided, because generation of the internal interrupt signal activating the tone generator section occurs a plurality of times within each frame and the predetermined number of tone data can be completely formed by just tone data forming operations being effected only when the internal interrupt signal is actually generated.

Figure 5:
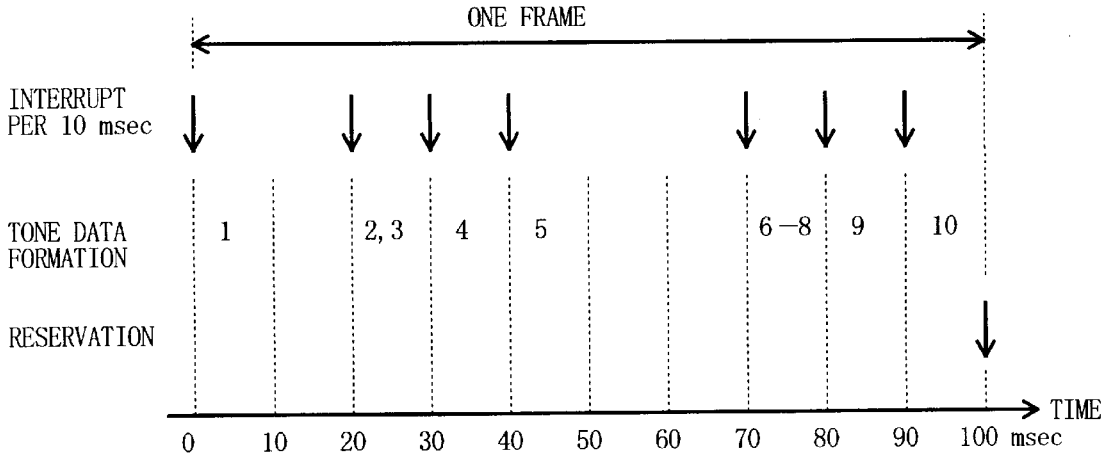
FIG. 5 is a diagram explanatory of an example of Measure 1 that can be employed in the present invention.
Figure 6:
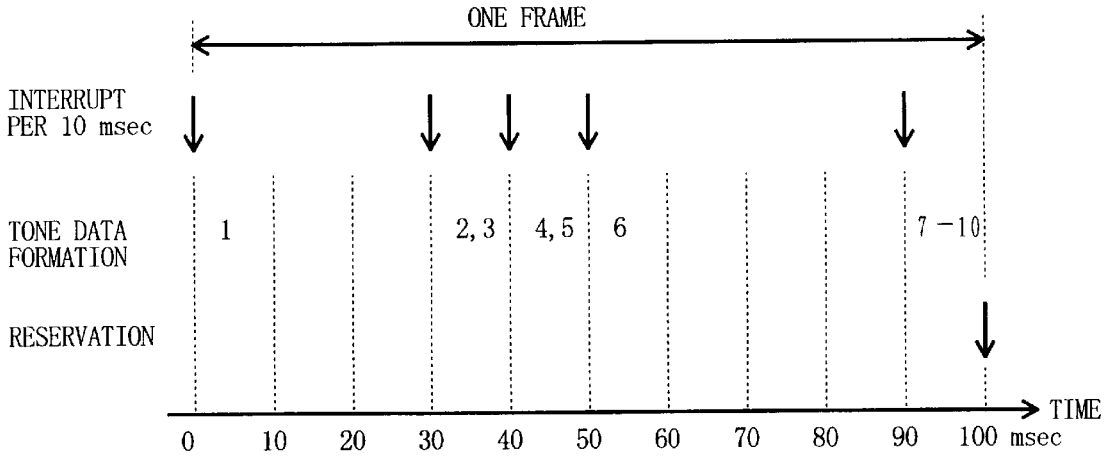
FIG. 6 is a diagram explanatory of another example of Measure 1 that can be employed in the present invention.

FIGS. 5 and 6 are explanatory of two typical examples of Measure 1, according to which internal interrupt signals activating the tone generator section are generated in a frame of 100 milliseconds at predetermined intervals of 10 milliseconds (hence, 10 internal interrupt signals are generated per frame) and one tenth of the predetermined number of tone data is formed each time the tone generator section is activated by the interrupt signal.

In the scheme of FIG. 5, all tone data that failed to be formed due to a failure of the internal interrupt signal generation are belatedly formed in response to generation of a next internal interrupt signal. Namely, in the illustrated scheme, all tone data that failed to be formed due to a failure of the internal interrupt signal generation at the second interrupt or activating time (corresponding to 10th millisecond point in the figure) are formed, in response to the internal interrupt signal generated at the third activating time (corresponding to 20th millisecond point), together with tone data originally allocated to that point (as denoted by "2" and "3" in the figure). Also, all tone data that failed to be formed due to a failure of the internal interrupt signal generation at the sixth and seventh activating times (corresponding to 50th and 60th millisecond points) are formed, in response to the internal interrupt signal generated at the eighth activating time (corresponding to 70th millisecond point), together with tone data originally allocated to that point (as denoted by "6–8" in the figure). The scheme of FIG. 5 has an advantage that the tone generation would hardly be delayed because the left-unformed tone data are belatedly formed collectively at once.

In the scheme of FIG. 6, on the other hand, all tone data that failed to be formed due to a failure of the internal interrupt signal generation are belatedly formed in a distributed fashion at a plurality of subsequent activating times when internal interrupt signals are actually generated. Namely, all tone data that failed to be formed due to a failure of the internal interrupt signal generation at the second and third activating times (corresponding to 10th and 20th millisecond points) are formed later, in response to the internal interrupt signals actually generated at the fourth and fifth activating times (corresponding to 30th and 40th millisecond points), together with tone data originally allocated to that point (as denoted by "2", "3" and "4", "5" in the figure). However, at the last or 10th activating time (corresponding to 90th millisecond point), all tone data that failed to be formed due to a failure of the internal interrupt signal generation at the seventh, eighth and ninth activating times (corresponding to 60th, 70th and 80th millisecond points) are formed together in order to assure formation of the "predetermined number of tone data to be written in one output buffer" within the frame. Because the scheme of FIG. 6 forms the left-unformed tone data at a plurality of appropriately distributed points if the left-unformed tone data amount to a great quantity, each processing time can be controlled to not be too long, so that the CPU can be used efficiently.

While in the scheme of FIG. 6, all tone data that failed to be formed due to the failure of the internal interrupt signal generation, i.e., left-unformed tone data, are formed in a distributed fashion at one or more subsequent activating times in a predetermined quantity, these left-unformed tone data may be formed later in optional different quantities (e.g., the predetermined number, one and half of the predetermined number and half of the predetermined number.)

As another example of Measure 1, all the left-unformed tone data resulting from the failure of the internal interrupt signal generation may be formed progressively by the end of the last or 10th activating time within the same frame.

Figure 16:
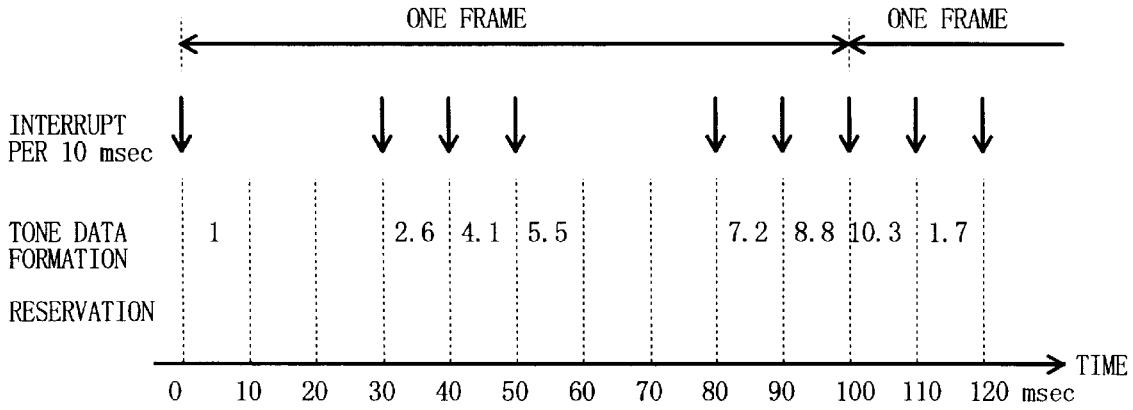
FIG. 16 is a diagram of still another example of Measure 1, showing an example of relation between generation of internal interrupt signals and quantities of tone data to be formed.

FIG. 16 is a diagram of still another example of Measure 1, which shows a case where the quantity of tone data to be formed in response to one internal interrupt signal (activating instruction) is not always an exact integral multiple of one tenth of the "predetermined number of tone data to be written in one output buffer" (one tenth of the predetermined number may be called one processed unit) as shown in FIGS. 5 and 6 but may sometimes be the processed unit plus a fraction.

The scheme of FIG. 16 is characterized in that at each of the points corresponding to the actually generated internal interrupt signal, a quantity of tone data to be formed in response to each internal interrupt signal (activating instruction) is determined as a function of a quantity of tone data left-unformed up to that point. FIG. 16 shows examples of the thus-determined quantity of tone data in relation to generation of the internal interrupt signals. In FIG. 16, one tenth of the "predetermined number of tone data to be written in one output buffer" are formed in a frame at a first activating time (corresponding to 0th millisecond point in the illustrated scheme) when an internal interrupt signal is generated in the frame. No tone data is formed at second and third activating times (corresponding to 10th and 20th millisecond points in the figure) due to a failure of the internal interrupt signal generation, and then, a specific quantity of tone data corresponding to 1.6/10 of the "predetermined number of tone data to be written in one output buffer" are formed at a fourth activating time (corresponding to 30th millisecond point) when another internal interrupt signal is generated. Thus, by the end of the fourth activating time, tone data have been formed up to a quantity corresponding to 2.6/10 of the "predetermined number of tone data to be written in one output buffer", as denoted by "2.6" in the figure.

Then, another specific quantity of tone data corresponding to 1.5/10 of the "predetermined number of tone data to be written in one output buffer" are formed at a fifth activating time (corresponding to 40th millisecond point) when another internal interrupt signal is generated. Thus, by the end of the fifth activating time, tone data have been formed up to a quantity corresponding to 4.1/10 of the "predetermined number of tone data to be written in one output buffer", as denoted by "4.1" in the figure. After this, still another specific quantity of tone data corresponding to 1.4/10 of the "predetermined number of tone data to be written in one output buffer" are formed at a sixth activating time (corresponding to 50th millisecond point) when still another internal interrupt signal is generated. Thus, by the end of the sixth activating time, tone data have been formed up to a quantity corresponding to 5.5/10 of the "predetermined number of tone data to be written in one output buffer", as denoted by "5.5" in the figure.

No tone data is formed at seventh and eighth activating times (corresponding to 60th and 70th millisecond points) due to a failure of internal interrupt signal generation, and then, yet another specific quantity of tone data corresponding to 1.7/10 of the "predetermined number of tone data to be written in one output buffer" are formed at a ninth activating time (corresponding to 80th millisecond point) when yet another internal interrupt signal is generated. Thus, by the end of the ninth activating time, tone data have been belatedly formed up to a quantity corresponding to 7.2/10 of the "predetermined number of tone data to be written in one output buffer", as denoted by "7.2" in the figure. After this, still another specific quantity of tone data corresponding to 1.6/10 of the "predetermined number of tone data to be written in one output buffer" are formed at a tenth activating time (90th millisecond point) when still another internal interrupt signal is generated. Thus, by the end of the tenth activating time, tone data have been formed, as a total for the frame, up to a quantity corresponding to 8.8/10 of the "predetermined number of tone data to be written in one output buffer", as denoted by "8.8" in the figure.

Then, at a first activating time (100th millisecond point in the figure) of a next frame when another internal interrupt signal is generated, another quantity of tone data left unformed in the preceding frame corresponding to 1.2/10 of the "predetermined number of tone data to be written in one output buffer" are formed along with a specific quantity of tone data to be formed in the current frame corresponding to 0.3/10 of the "predetermined number of tone data to be written in one output buffer", as denoted by "10.3" in the figure. Because tone data exceeding the "predetermined number of tone data to be written in one output buffer" have been formed so far, those (i.e., 10/10) of the formed tone data corresponding to the "predetermined number of tone data to be written in one output buffer" are taken out of the formed data group and supplied to the output device so that their reproduction is reserved. As a result, the tone data corresponding to 0.3/10 of the predetermined number to be written in one output buffer are left as "tone data under formation".

After this, still another specific quantity of tone data corresponding to 1.4/10 of the "predetermined number of tone data to be written in one output buffer" for the current frame are formed at a second activating time (110th millisecond point) of the current frame when still another internal interrupt signal is generated. Thus, by the end of the second activating time, tone data have been formed up to a total quantity corresponding to 1.7/10 of the "predetermined number of tone data to be written in one output buffer" for the current frame, as denoted by "1.7" in the figure. After this, tone data will be formed in response to each internal interrupt signal in the above-mentioned manner until the total quantity reaches a predetermined upper limit value SRmax. When the determined quantity of tone data to be formed is more than the upper limit value SRmax, appropriate control is made such that the quantity falls at or below the value SRmax.

According to the scheme of FIG. 16 noted above, each time the internal interrupt signal or activating instruction is generated by the software timer, a quantity of tone data to be formed in determined, as a function of a quantity of tone data left-unformed up to that time point, within a limit such that too much time will not be spent on the tone generating processing, and then processing is executed to form tone data up to the determined quantity. With the processing executed in response to each internal interrupt signal, the left-unformed tone data will be formed in a progressive manner. Namely, the scheme of FIG. 16 is identical to the schemes of FIGS. 5 and 6 in that the tone generating processing is activated in response to each internal interrupt signal and affords generally the same benefits as attained by the schemes of FIGS. 5 and 6; however, the scheme of FIG. 16 is different from the schemes of FIGS. 5 and 6 in that the left-unformed tone data are formed progressively in accordance with predetermined functions rather than being formed collectively at one time, and thus it can attain unique benefits. In other words, the CPU 3 can be prevented from being used, for a long time, exclusively for the tone generating processing by the software tone generator module SSM, so that when the CPU 3 is to execute the tone generating processing and other processing in a parallel fashion or when there is need to execute low-priority processing other than the tone generating processing by means of the software tone generator module SSM, the scheme of FIG. 16 permits a prompt shift to the other processing to thereby achieve efficient use of the resources.

For instance, with the scheme of FIG. 5, the formation of the left-unformed tone data may be conducted at the highest speed, but in the event that many internal interrupt signals fail to be generated consecutively, a considerably great number of tone data have to be formed when the internal interrupt signal is actually generated at a time immediately after such failure. In such a case, the CPU 3 would take a long time to execute the tone generating processing by means of the software tone generator module SSM and hence tends to be used exclusively for the tone generating processing. Thus, there is a possibility that when there occurs any factor to trigger processing having lower priority than the tone generating processing by the software tone generator module SSM, the CPU 3 is not able to execute the lower-order processing promptly. If the number of tone data to be formed per unit time becomes so great, the number of tone generating channels capable of simultaneously forming tone data may decrease extremely. However, these inconveniences can be avoided by adopting the scheme of FIG. 16. For this reason, an embodiment will be described in detail below in relation to a case where the scheme of FIG. 16 is employed.

By the way, if many internal interrupt signals fail to be generated leaving a great number of tone data unformed, the tone data forming operations might not be completed in every assigned tone generating channel at one or more subsequent activating times where the interrupt signal is actually generated. Therefore, in Measure 1, it is desirable that formation of the tone data be achieved by appropriately reducing the number of the tone generating channels to be used for that purpose. The number of such tone generating channels to be reduced is the greatest in the scheme of FIG. 5; in the case of FIG. 6, in other cases where the left-unformed tone data are formed progressively by the end of the last activating time, and in the case of FIG. 16, the number of the tone generating channels to be reduced is smaller than in the case of the FIG. 5 example; however, the example of FIG. 5 is most desirable if the left-unformed tone data are to be formed promptly.

<Measure 2>

According to this measure, there are provided, as the tone generator register for each of the tone generating channels, a first register (primary tone generator register) for storing parameters to control current tone generating processing assigned when the channel is not in use or available, and a second register (secondary tone generator register) for storing parameters to control new tone generating processing assigned when the channel is still in use for the current tone generating processing and hence unavailable for the new tone generating processing. As the tone generator register to be used for the tone generating channel, the primary tone generator register is selected until predetermined timing to start the new tone generating processing, and the secondary tone generator register is selected after the timing to start the new tone generating processing.

With such Measure 2, even when new tone generating processing is assigned to one of the tone generating channels still in use for the current tone generating processing, the new tone generating processing can be immediately furnished or prepared in the secondary tone generator register while securing continued execution of the current tone generating processing in the channel using the primary tone generator register. In this way, it is possible to prevent any time delay in the tone data formation that would otherwise result from a time delay in preparing the new tone generating processing.

<Measure 3>

According to this measure, a plurality of output buffers are provided in the RAM 5, and reproduction from some of the output buffers is reserved in the output device prior to the activation of the tone generator section. Even when the tone generator section is prevented from being duly generated at a predetermined activating time due to an influence of the other processing, tones can be reproduced with no appreciable break in a stream of generated tones as long as the the tone generator section is activated and reproduction from another output buffer is reserved before the previously-reserved reproduction from the output buffers is completed. Thus, this measure expands such a tolerable range of time delay in the activation of the tone generator section that can prevent a break in a stream of generated tones.

Figure 7:
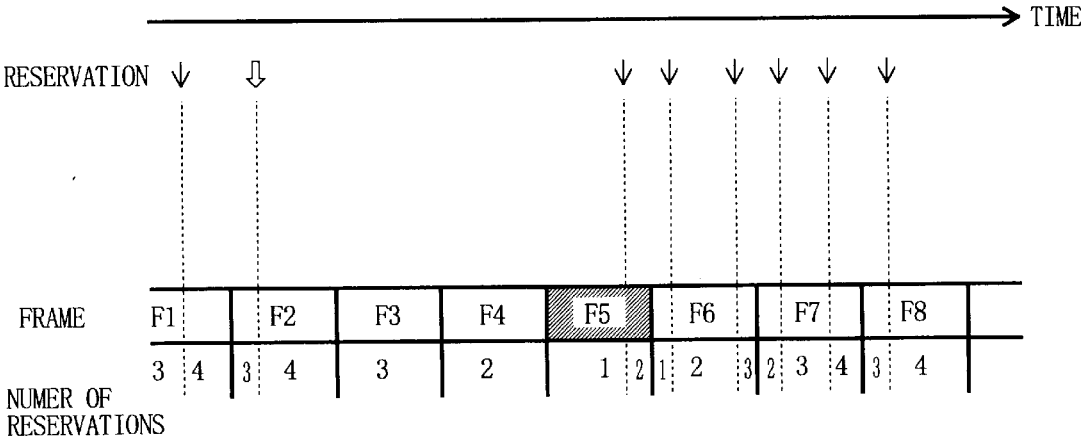
FIG. 7 is a diagram explanatory of an example of Measure 3 that can be employed in the present invention.

FIG. 7 is a diagram explanatory of exemplary details of Measure 3, according to which reproduction from four output buffers is reserved in the output device prior to the activation of the tone generator section. The number of reserved output buffers at the start of frame F1 is "3" now that reproduction from one of the four output buffers has been completed in the preceding frame, but during frame F1, the number of reserved output buffers is increased to "4" because formation of the "predetermined number of tone data to be written in one output buffer" has been completed and reproduction from the output buffer has been reserved. Then, the number of reserved output buffers is decreased to "3" after frame F1 now that reproduction from another one of the four output buffers has been completed, but during next frame F2, the number of reserved output buffers is again increased to "4" because formation of the predetermined number of tone data to be written in the next output buffer has been completed and reproduction from that output buffer has been reserved.

After that, the number of reserved output buffers is decreased to "1" at the end of frame F4 because no tone data is formed due to a time delay in the activation of the tone generator section. Then, in frame F5, tone data are reproduced from the last one of the reserved output buffers (i.e., the output buffer reserved during frame 2); occurrence of the reproduction reservation made during frame 2 is denoted by a heavy white arrow, while frame F5 is denoted by halftone dot meshing. During frame F5, the number of reserved output buffers is increased to "2" because formation of the "predetermined number of tone data to be written in one output buffer" has been completed and reproduction from that output buffer has been reserved. Similarly, after frame 5, the number of reserved output buffers is increased and decreased in response to completion of the reproduction and occurrence of the reproduction reservation.

In the above-mentioned manner, even when the tone generator section fails to be duly generated at a predetermined activating time due to an influence of the other processing, tones can be appropriately reproduced with no delay as long as the the tone generator section is activated and reproduction from another output buffer is duly reserved before the prior reserved reproduction from the four output buffers is completed. If the formation of tone data to be written in the next output buffer is completed during a particular frame when the number of reserved output buffers is "4", reproduction reservation of the output buffer is made only after completion of the reproduction in the frame so that the number of reserved output buffers does not exceed "4".

The output buffers that should be provided in the RAM 5 to carry out Measure 3 include those for effecting the reproduction reservation prior to the activation of the tone generator section, one for writing thereinto tone data completely formed by the tone generator section, and one or more spare output buffers to be used in case the quantity of the tone data actually formed by the tone generator section exceeds the "predetermined number of tone data to be written in one output buffer". The total number of the output buffers is "6" in the example of FIG. 7. However, the spare output buffers may be omitted if the tone data formation is compulsorily stopped when the quantity of the actually formed tone exceeds the "predetermined number of tone data to be written in one output buffer". Thus, a total of five output buffers will be sufficient in the example of FIG. 7.

<Measure 4>

In case no output buffer is reserved in the output device within a predetermined time period, tone data forming operations that should have been completed by that time is compulsorily discontinued, and new arithmetic forming operations are caused to begin with tone data originally scheduled for that time. According to this measure, even when the reproduction reservation can not be made in time and thus a temporary disorder is caused in generated tones, stable tone formation can be promptly restored so that accompanying noise is minimized.

In the example of Measure 3 of FIG. 7, reproduction reservation of the output buffer having stored therein tone data formed by the tone generator section is shown as being made by the time when reproduction has been completed for every output buffer previously reserved in the output device. However, in case the activation of the tone generator section is greatly delayed by an influence of the other processing, it is possible that the reproduction reservation of the output buffer having stored therein tone data formed by the tone generator section is not timely made even in a frame where the reproduction from every previously reserved output buffer has been completed (i.e., the number of reserved output buffers is decreased to "0"). In such a case, by effecting Measure 3 and Measure 4 in combination, arithmetic forming operations of tone data that should have been completed before the number of reserved output buffers becomes "0" is discontinued compulsorily, another output buffer reservation is made in the output device, and then new arithmetic forming operations are caused to begin with tone data originally scheduled for that time.

A detailed description will now be made about an example of operation of the tone generator system using computer software which is designed to effect the above-mentioned measures, with reference to FIGS. 8 to 25. First of all, a description will be given about an embodiment corresponding to the system configuration of FIG. 1 (i.e., an embodiment using the fake MIDI driver).

Figure 8:
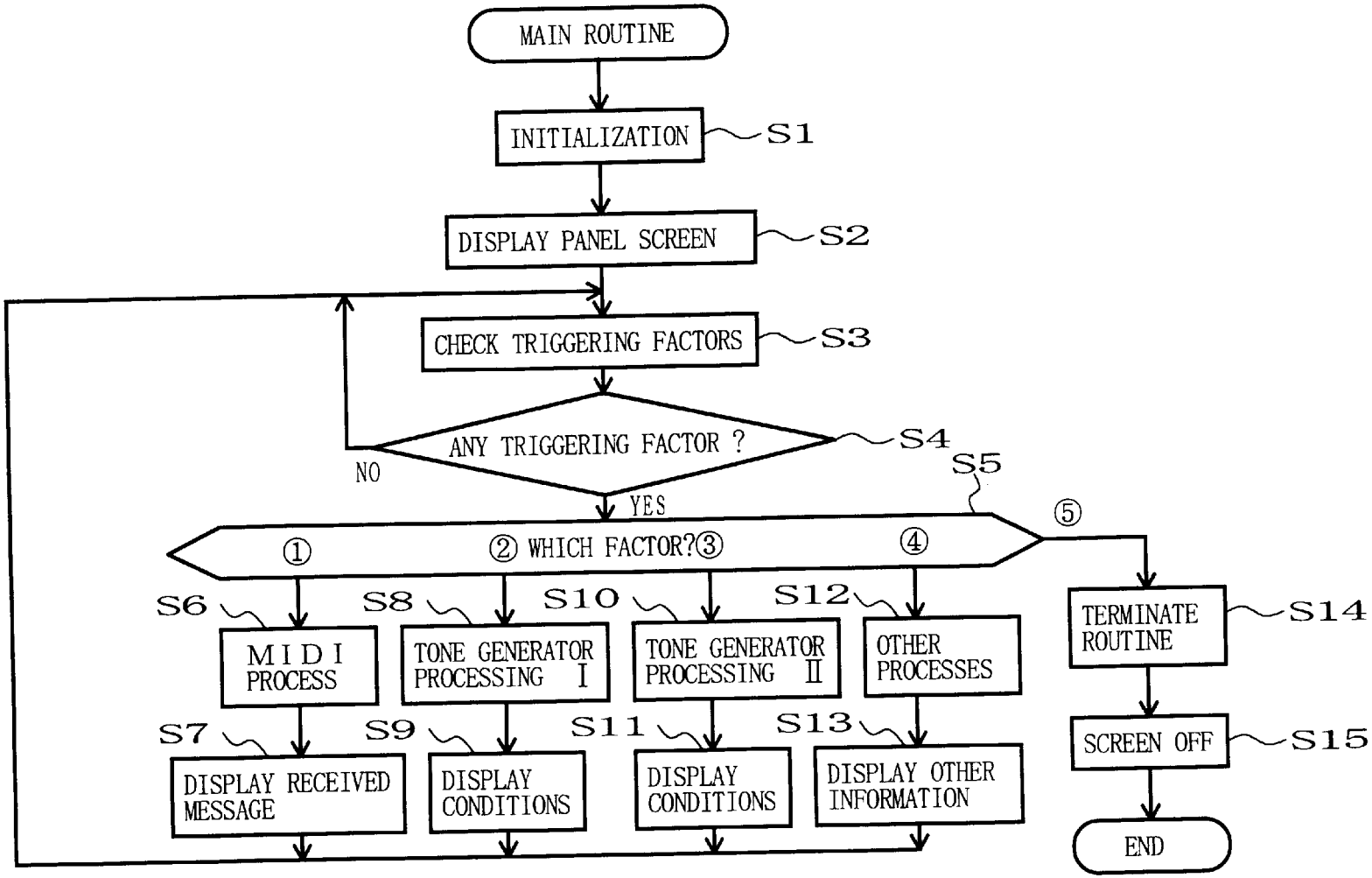
FIG. 8 is a flowchart of a main routine executed by a CPU of FIG. 3.
Figure 9:
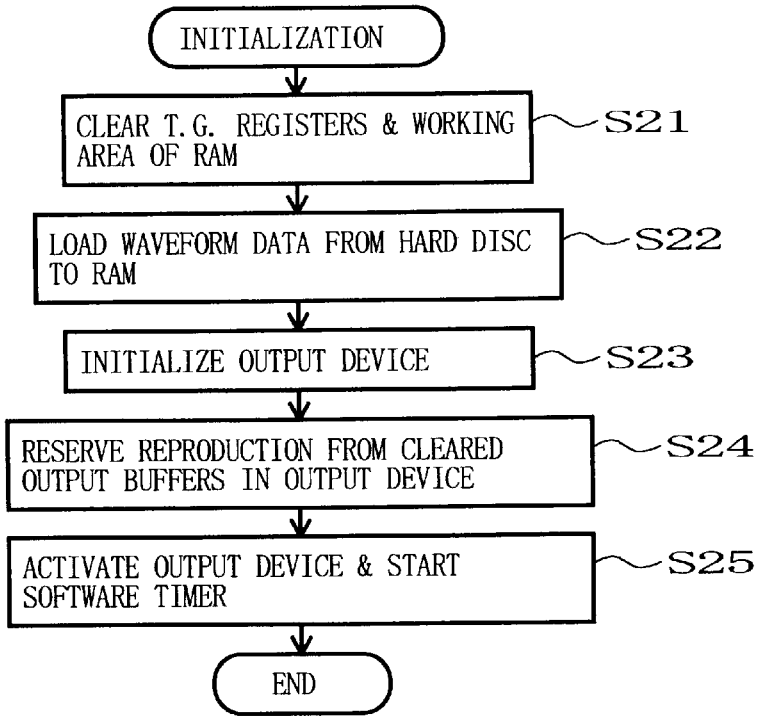
FIG. 9 is a flowchart of an initialization process of FIG. 8 executed by the CPU.

FIG. 8 is a flowchart of a main routine of the software tone generator module SSM executed by the CPU 3 of FIG. 1. First, an initialization process is executed at step S1, which includes clearing data stored in the tone generator registers for all the tone generating channels (including the primary and secondary tone generator registers as mentioned earlier in connection with Measure 2), as well as data stored in the working area of the RAM 5 (including the output buffers as mentioned earlier in connection with Measure 3) at step S21 of FIG. 9. Then, waveform data recorded on the hard disk device 10 are loaded into the RAM 5 at step S22 of FIG. 9. Following this, the output device is initialized at step S23, and reproduction from the cleared output buffers (here, "four" output buffers as in the example of FIG. 7) is reserved, at step S24, in the output device prior to the activation of the tone generator section as mentioned earlier in connection with Measure 3. Then, at step S25, the output device is activated by the D/A converter 12 generating and passing a reproduction sampling clock pulse to the DMA controller 11, and the software timer is activated to generate an internal interrupt signal for activating the tone generator section. For example, the software timer is designed to generate an internal interrupt signal by the CPU 3 referring to a hardware timer.

As earlier mentioned in connection with Measure 1, the software timer is capable of generating internal interrupt signals (activating instructions) at a plurality of timing or activating times in each of the frames (it is assumed here that internal interrupt signals can be generated ten times in each frame having a length of 100 milliseconds, i.e., at intervals of 10 milliseconds, as in the examples of FIGS. 5, 6 and 16). As set forth previously, the internal interrupt signal is not necessarily generated by the software timer at each activating time (i.e., every 10 milliseconds); namely, when the CPU 3 is engaged in processing by the operating system or other software processing, the internal interrupt signal (activating instruction) can not be generated even when the activating time arrives. So, according to the embodiment, a timer flag is set whenever the timer 2 counts out passage of a predetermined time length corresponding to one activating time (e.g., 10 milliseconds), a current state of the timer flag is checked once the CPU 3 becomes available for the processing of the software tone generator, so that the interrupt signal is generated in accordance with the current state of the flag. When the flag indicates that the necessary tone generating processing is left unexecuted, the internal interrupt signal (activating instruction) is generated and the flag is reset. Thus, one internal interrupt signal is generated whenever the CPU 3 is determined as available for the processing of the software tone generator during the predetermined time length corresponding to one activating time (e.g., 10 milliseconds). However, whenever the CPU 3 is determined as not available for the processing of the software tone generator during the predetermined time length corresponding to one activating time (e.g., 10 milliseconds), the CPU 3 does not check the timer flag and hence the predetermined time elapses with no internal interrupt signal generated and then a next flag will be set; that is, no internal interrupt signal is generated in response to the preceding flag.

In this way, the internal interrupt signal (activating instruction) is not necessarily generated at each activating time, as illustrated in FIGS. 5, 6 and 16. Further, as may be understood from the foregoing, the intervals between the internal interrupt signals generated consecutively at several activating times are not always accurately fixed to the predetermined time length (e.g., 10 milliseconds) but may vary to be slightly shorter or longer than 10 milliseconds. Because, the exact generation timing of the internal interrupt signal (activating instruction) depends on the processing condition of the CPU 3 (i.e., on when the CPU 3 checks the timer flag).

Referring back to FIG. 8, after the initialization process, there is visually presented, on the display 9, a panel screen (not shown) for indicating various information corresponding to the progression of the processing and for being used by an user or human operator to enter various control data with the mouse 7, at step S2. Because reproduction from several output buffers are reserved in the output buffer by the initialization (FIG. 9) prior to the activation of the tone generator section, the output device first executes the reproduction of the previously-reserved four output buffers and then reproduction of output buffers subsequently reserved by the tone generator section. Thus, the tone reproduction responsive to supplied MIDI messages will be delayed by a total time length of the frames corresponding to the number of the previously-reserved output buffers (four frames in the example of FIG. 7). In a case where information based on a supplied MIDI message is presented on the panel screen of the display 9, it is desirable to defer the display timing by the total time length of the frames corresponding to the number of the previously-reserved output buffers.

At step S3 following step S2, the main routine checks occurrence of the following activating or triggering factors:

Triggering factor 1: Supply of a MIDI message via the API of the software tone generator module (e.g., the "SGM MIDI out API" which will be hereinafter referred to as a "software tone generator API"); namely, supply of a MIDI message from the application APS1 or APS2 (see FIG. 1);

Triggering factor 2: Generation, by the software timer, of an internal interrupt signal activating the tone generator section (although the internal interrupt signal is set to be generated at predetermined intervals, i.e., 10 milliseconds, it is not necessarily generated accurately at such predetermined intervals);

Triggering factor 3: Detection of a processing request from the output device;

Triggering factor 4: Detection of another request such as an input event on the panel screen of the display 9 or a command input event on the keyboard 8 (excluding a main routine ending command); and Triggering factor 5: Detection of an input event of a main routine ending command on the keyboard 8.

After step S3, a determination is made at step S4 as to whether or not any one of the above-mentioned triggering factors has occurred. If answered in the negative at step S4, the main routine reverts to step S3 in order to repeat the operations of steps S3 and S4 until any one of the above-mentioned triggering factors occurs. Upon occurrence of any one of the triggering factors, an affirmative determination results at step S4 and the main routine moves on to step S5, where a further determination is made as to which of the triggering factors has occurred. Then, different operations are performed depending on the triggering factor detected.

Figure 17:
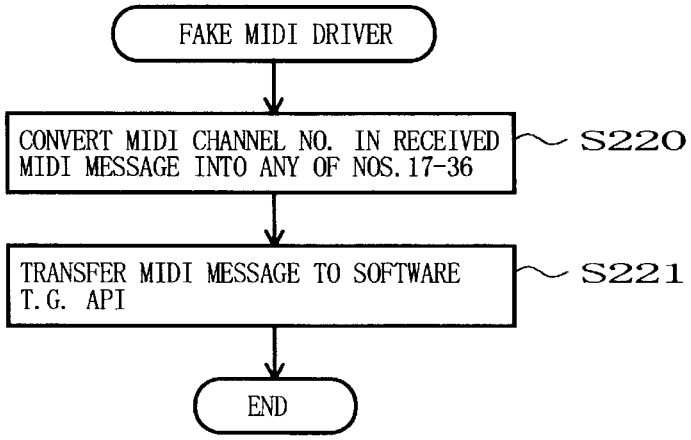
FIG. 17 is a flowchart of an exemplary program of a fake MIDI driver FMD shown in FIG. 1.
Figure 18:
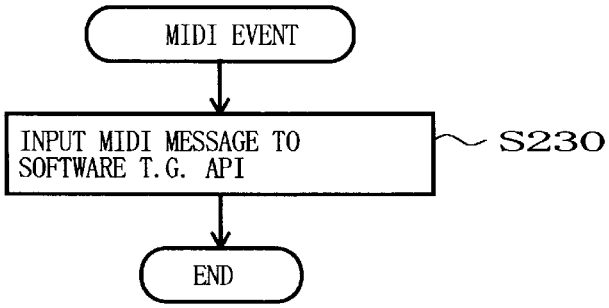
FIG. 18 is a flowchart of an example of a MIDI event process program contained in application software dedicated to the software tone generator of FIG. 1.

The following paragraphs describe exemplary programs of other software which give rise to triggering factor 1, with reference to FIGS. 17 and 18.

FIG. 17 is a flowchart of an exemplary program of the fake MIDI driver FMD shown in FIG. 1. This program for the fake MIDI driver FMD is triggered when a MIDI message is supplied from the application software APS1 (FIG. 1) to the first interface IF1 (i.e., "MIDI API") of the operating system (OS). Assume here that the MIDI message supplied from the application software APS1 (FIG. 1) contains MIDI channel number information indicating any of channel numbers 1–16. At step S220, an operation is performed for converting the MIDI channel number in the MIDI message supplied to the first interface IF1 (i.e., "MIDI API") into any of channel numbers 17–36. This is because the software tone generator according to the embodiment comprises 36 channels having channel numbers 1–36 (32 parts), of which channels of numbers 1–16 are allocated to the application software APS2 (FIG. 1) dedicated to the software tone generator and the remaining channels of numbers 17–36 are allocated to the other application software APS1 involving the use of the fake MIDI driver FMD. Therefore, if the software tone generator is used only in connection with the application software APS 1 involving the use of the fake MIDI driver FMD, the operation of step S220 may be omitted.

At next step S221, an operation is performed for transferring, to the software tone generator API (API of the software tone generator module SSM), the MIDI message that has been received via the first interface IF1 (i.e., "MIDI API") and undergone the channel number conversion at step S220. By detecting the MIDI message transfer, the software tone generator module SSM determines that the above-mentioned triggering factor 1 has taken place.

FIG. 18 is a flowchart of an example of a MIDI event process program in the application software APS2 (FIG. 1) dedicated to the software tone generator. This MIDI event process is triggered in response to occurrence of a MIDI event during execution of the application software APS2. At step S230, an operation is performed for inputting, to the software tone generator API, a MIDI message relating to the MIDI event. By detecting the MIDI message input, the software tone generator module SSM determines that the above-mentioned triggering factor 1 has taken place.

In the above-mentioned manner, triggering factor 1 occurs in response to the supply of a MIDI message from either one of the dedicated application software APS2 and the application software APS1 combined with the software tone generator on the OS level. The software tone generator executes the tone generating processing based on the two application software by properly using the 36 channels.

The MIDI channel number conversion may be conducted in any other manner than the above-mentioned. For example, the channels of numbers 1–16 may be allocated to the application software APS1 involving the use of the fake MIDI driver FMD while the remaining channels of numbers 17–36 may be allocated to the application software APS2 dedicated to the software tone generator. In such a case, the MIDI channel number conversion as shown at step S220 of FIG. 17 is conducted using the program of FIG. 18.

Referring back to FIG. 8, if triggering factor 1 (i.e., supply of a MIDI message) has occurred as determined at step S5, the MIDI process is executed at step S6 and a predetermined visual display of the received message data, such as data indicating for which of MIDI channels the MIDI message has been supplied, is made at step S7 on the panel screen. After this, the main routine loops back to step S3 in order to repeat the above-mentioned operations at and after step S3.

Figure 10:
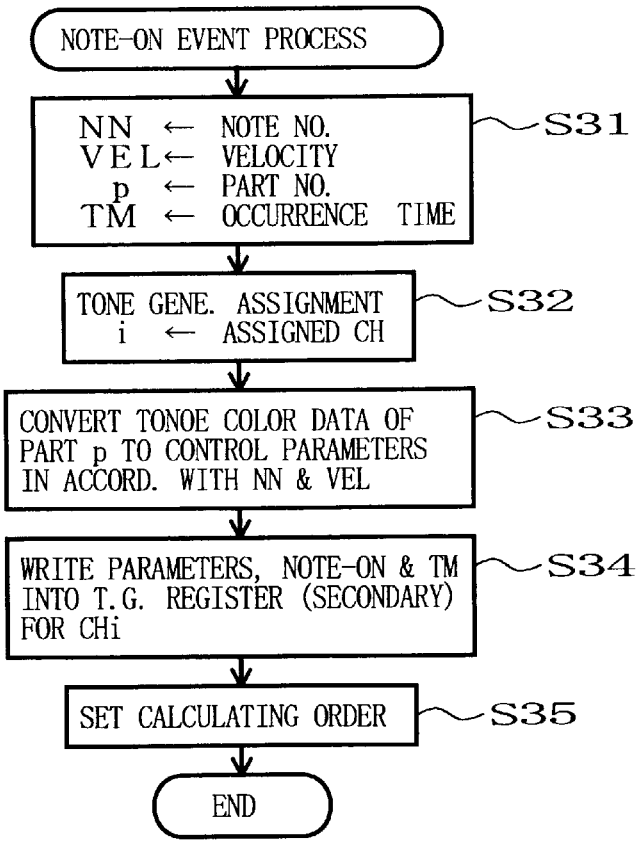
FIG. 10 is a flowchart illustrating an example of a note-on event process executed by the CPU in a MIDI process of FIG. 8.

The MIDI process at step S6 includes note-on event and note-off event processes based on note-on and note-off event data. FIG. 10 is a flowchart illustrating an example of the note-on event process. At first step S31, data indicative of the note number and velocity of the note-on event, part number of a performance part associated with the note-on MIDI channel and occurrence time of the note-on event are stored into respective registers NN, VEL, p and TM. At next step S32, one of the tone generating channels is assigned to tone generation based on the note-on event, and the number of the assigned channel is stored into register i. Then, at step S33, voice data of the tone color selected for the part number stored in register p is read out from the RAM 5 and then converted into control parameters (including a pitch-designating frequency number FN) for controlling the tone generator section in accordance with the note number and velocity stored in the registers NN, VEL (FIG. 2).

Then, at next step S34, the control parameters are stored, along with the note-on event data and event occurrence time in register TM, into the tone generator register for the tone generating channel of the channel number indicated by register i, so as to reserve note-on operations for timing corresponding to the occurrence time.

The reasons for storing the event occurrence time from register TM into the tone generator register are as follows. As previously mentioned, there may be a time difference, approximately corresponding to four frames, between the note-on event occurrence time and the time when the tone reproduction is actually initiated on the basis of the note-on event; that is, the start of the tone reproduction is delayed by the time corresponding to about four frames. It is sufficient that the tone generating processing (corresponding to later-described "tone generator processing I") generate corresponding tone data at any optional timing within a range of the time difference; that is, a processing time delay within that range is tolerated. Thus, without knowing the note-on event occurrence time, the tone generating processing executed at any optional timing different from the occurrence time will be unable to generate the corresponding tone data.

In case the tone generating channel in question is in use, step S34 stores the control parameters into the secondary tone generator register rather than the primary tone generator register, as previously described in connection with Measure 2. In this way, new tone generating processing can be immediately prepared in the secondary tone generator register while securing continued execution of the current tone generating processing in the tone generating channel using the primary tone generator register. In the event that the control parameters are stored into the secondary tone generator register, a reservation is made, in a predetermined reservation area of the primary tone generator register, for damping (rapid attenuation of a tone volume envelope) at such timing corresponding to the occurrence time stored in register TM.

At step S35 following step S34, a calculating order across all the tone generating channels assigned to the tone generation is set such that the tone generating calculation begins with the channel assigned to generate a tone of the last note-on occurrence time and ends with the channel assigned to generate a tone of the earliest note-on occurrence time, i.e., that the channel assigned to generate a tone of the last note-on occurrence time has priority over the other channels in the tone generating calculation. After step S35, the CPU 3 returns to the main routine.

Figure 11:
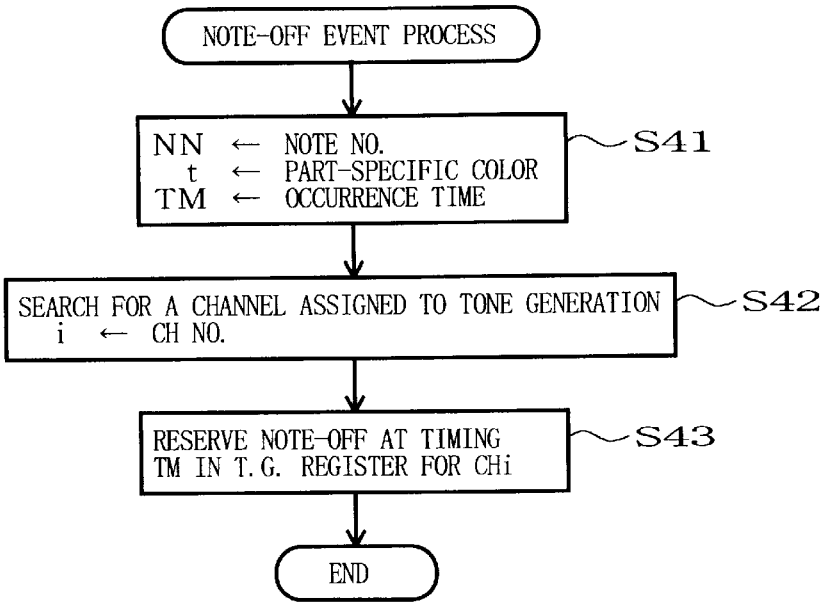
FIG. 11 is a flowchart illustrating an example of a note-off event process executed by the CPU in the MIDI process of FIG. 8.

FIG. 11 is a flowchart illustrating an example of the note-off event process. At first step S41, data indicative of the note number of the note-off event, tone color selected for the performance part associated with the note-off MIDI channel and occurrence time of the note-off event are stored into respective registers NN, t and TM. Then, at step S42, a search is made for one of the tone generating channels assigned to generate a tone with the color stored in register t, and its channel number (CH NO.) is stored into register i.

After this, in a predetermined reservation area of one of the primary and secondary tone generator registers for the tone generating channel of the number stored in register i (CHi), a reservation is made for note-off operations at timing corresponding to the occurrence time stored in register TM, at step S43.

Referring back to step S5 of FIG. 8, if triggering factor 2 (i.e., generation, by the software timer, of an internal interrupt signal activating the tone generator section) has occurred, the CPU 3 executes "tone generator processing I" at step S8 and goes to step S9 in order to visually present predetermined conditions, such as the computing capability of the CPU 3 and volume level of each generated tone, on the panel screen of the display. Then, the CPU 3 loops back to step S3 to repeat the operations at and after step 3.

Tone generator processing I forms part of the above-mentioned tone generator section. As shown in detail in FIG. 12, at first step S50, the CPU 3 subtracts, from a current time GT, an input time ST of one of MIDI messages for which the tone generation has been completed last and then sets the value of the subtraction result as a delay amount OR (this amount OR represents a quantity of tone data that have not yet been formed by the current time although they should have been, which is expressed in a corresponding time length). At next step S51, a quantity-to-be-formed SR (which is expression, in time length, of a target number of samples of tone data data to be formed by the current activation corresponding to a target number of sample of tone data to be formed by the current activation of the tone generator section) is determined as a function of the delay amount OR.

Figure 19:
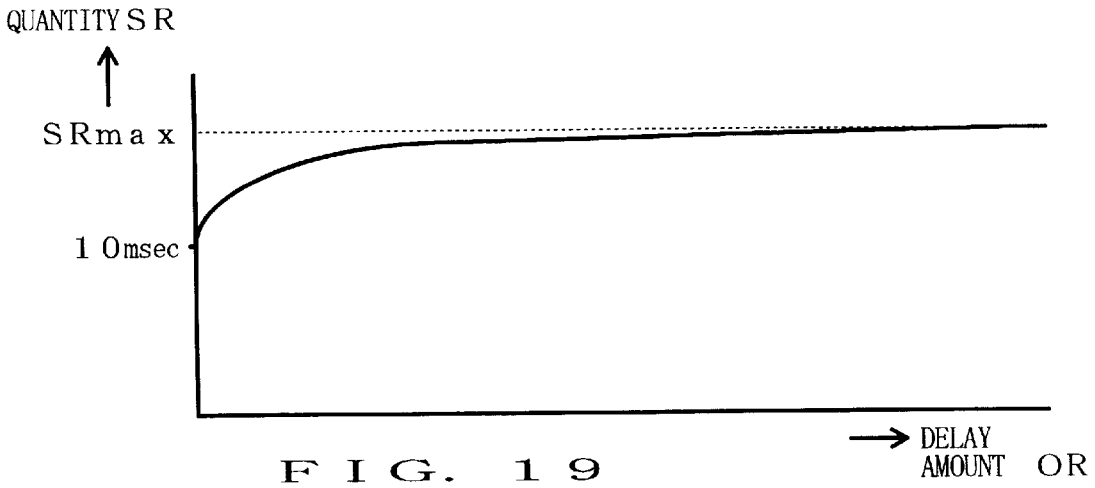
FIG. 19 is a graph of an exemplary characteristic curve of a function in determining quantity-to-be-formed SR as a function of delay amount.

FIG. 19 is a graph illustrating an example of a characteristic curve of that function. In this example, the quantity-to-be-formed SR is set to 10 milliseconds (corresponding to one tenth of the "predetermined number of tone data to be written in one output buffer") when the delay amount OR is smaller than a predetermined value, but after the delay amount OR exceeds a given value, it successively increases as the amount OR increases. Then, after the quantity-to-be-formed SR reaches a predetermined upper limit value SRmax within such a range assuring that the tone generating processing will not take too much time, the quantity SR is maintained at the upper limit value SRmax irrespective of a further increase in the delay amount OR. The upper limit value SRmax may, for example, be 20 milliseconds or may be any other suitable value.

Figure 20:
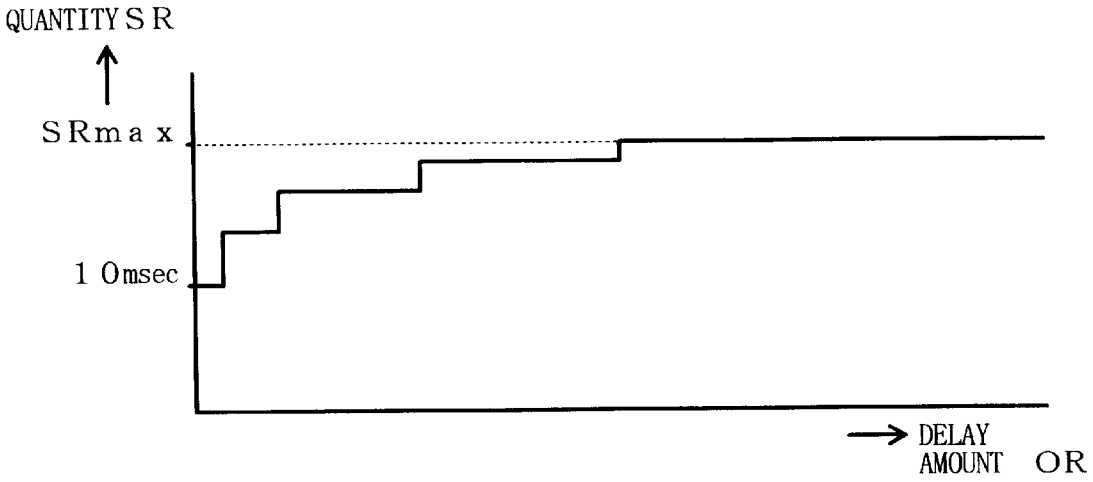
FIG. 20 is a graph of another exemplary characteristic curve of a function in determining quantity-to-be-formed SR as a function of delay amount.

FIG. 20 is a graph illustrating another example of the characteristic curve of the function. In this example, the quantity-to-be-formed SR is 10 milliseconds when the delay amount OR is smaller than a predetermined value, but after the delay amount OR exceeds a given value, it increases stepwise as the amount OR increases. Then, after the quantity-to-be-formed SR reaches a predetermined upper limit value SRmax within such a range assuring that the tone generating processing will not take too much time, the quantity SR is maintained at the upper limit value SRmax irrespective of a further increase in the delay amount OR.

Note that the quantity-to-be-formed SR set in the above-mentioned manner does not always take a value of an integral multiple of 10 milliseconds but may take a value of a multiple of 10 milliseconds plus some fraction. As a result, the quantity of tone data that are formed by one execution of "tone generator processing I" is not necessarily an exact integral multiple of one tenth of the "predetermined number of tone data to be written in one output buffer" (one processed unit), but may be a quantity corresponding to a multiple of 10 milliseconds plus a fraction as previously set forth in connection with the example of FIG. 16. The tone generator processing I of FIG. 12 executes the tone generating processing in a manner as shown in FIG. 16. Therefore, even when the internal interrupt signal (activating instruction) is not generated at some of the predetermined points in one frame, the "predetermined number of tone data to be written in one output buffer" can be efficiently formed in total only through the operations executed at the other activating times when the internal interrupt signal is actually generated. This arrangement reliably avoids an unwanted hindrance to not only the tone generating processing but also other processing.

Figure 21:
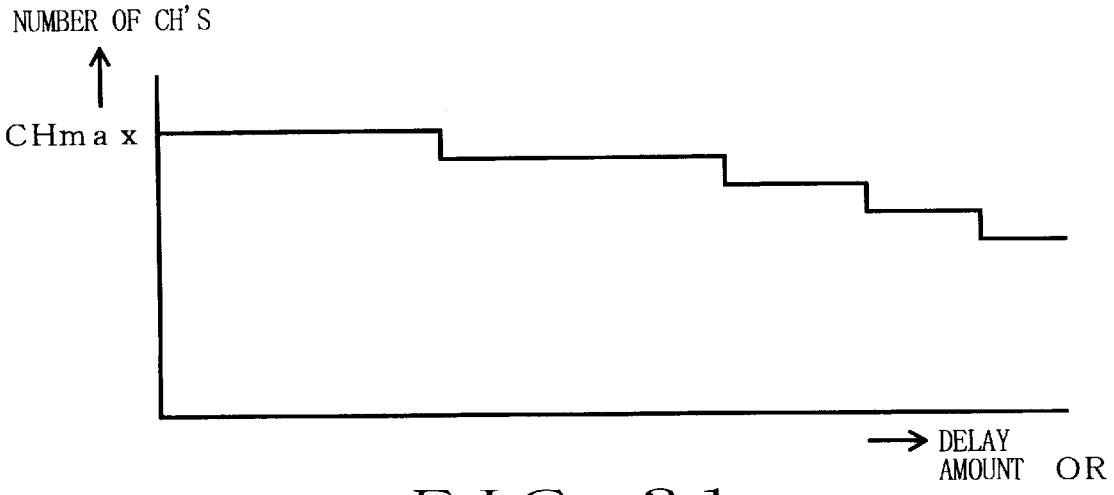
FIG. 21 is a graph of an exemplary characteristic curve of a function in determining the number of tone generating channels as a function of delay amount.
Figure 22:
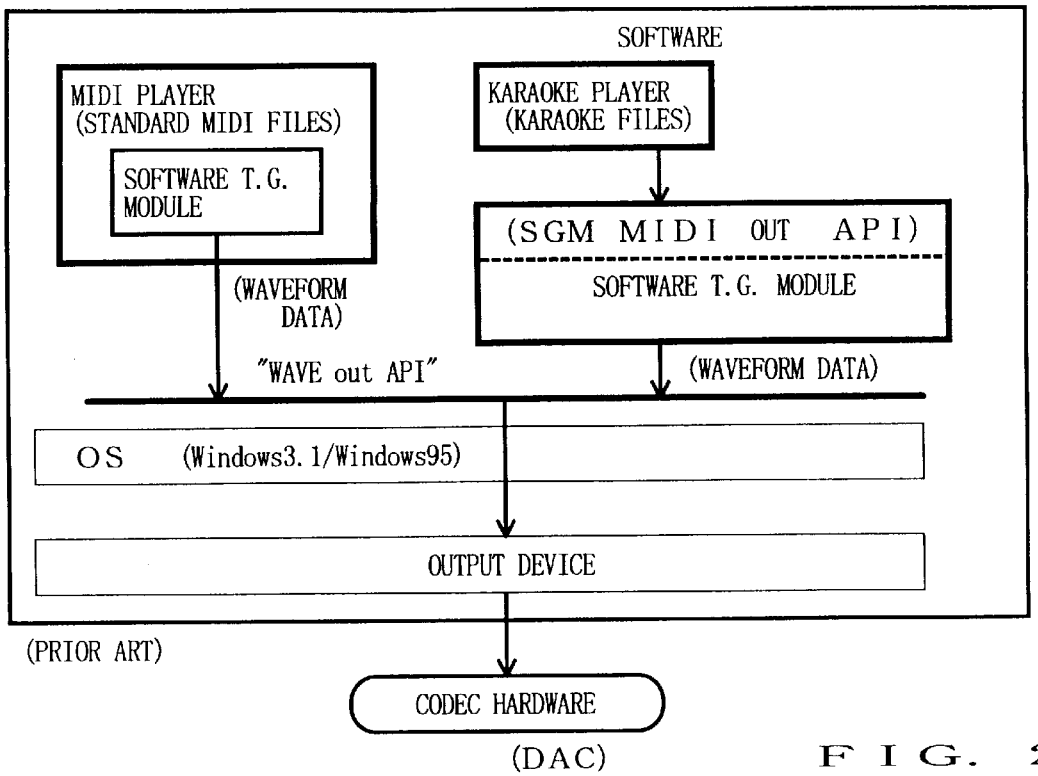
FIG. 22 is a block diagram illustrating a conventionally-known software system configuration implementing an application-level software tone generator.

At step S52 following step S51, a tone forming area for the quantity-to-be-formed SR starting at time ST is set in one of the output buffers other than those reserved in the initialization process. Next step S53 sets a specific number of the tone generating channels to be used for forming tone data. As an example, the number of the tone generating channels to be used for forming tone data may be determined as a function of the delay amount OR. FIG. 21 is a graph illustrating an example of a characteristic curve of that function. According to this example, if the delay amount OR is below a predetermined value, then the number CHmax of the channels assigned in the note-on process of FIG. 10 is directly set as the number of the tone generating channels to be used for forming tone data. If the delay amount OR is not below a predetermined value, then the number of the tone generating channels to be used for forming tone data is set to be smaller than the number of the assigned channels CHmax, so that it is possible to reduce the necessary time for one execution of the tone generating processing.

At next step S54, the channel number of the tone generating channel given the first place in the calculating order set at step S35 of the note-on event process is stored into register i, and start pointer sp is caused to point to the last input time ST. Following this, a first reservation (such as reservation for pitch bend, note-off or damping) within a period from the start pointer sp to the current time GT is detected at step S55 by reference to the reservation area in the primary tone generator register for the tone generating channel designated by register i. Then, a further determination is made at step S56 as to whether or not any reservation has been detected.

If answered in the affirmative at step S56, the tone generating processing up to the time of the detected reservation is executed and the start pointer sp is advanced to point to that time at step S57. As set forth above, the tone generating processing reads out waveform data from the RAM 5 at a rate according to the control parameters stored in the tone generator register. The read-out waveform data are then subjected to tone color control (filtering arithmetic operation), volume control (multiplication by tone volume envelope data), modulation control of pitch, color, volume, and effect impartment in accordance with the control parameters, so as to create tone data. The resultant created tone data is accumulatively added to the data having been so far stored in the output buffer.

At next step S58, the content of the detected reservation is stored into the tone generator register so as to carry out the reserved content. For example, if the detected reservation is for note-off operations, the note-off event data is stored into the primary tone generator register for the tone generating channel so as to start a release of the tone volume envelope. If the detected reservation is for damping, the tone generator register to be used for the tone generating channel is changed from the primary to the secondary as noted earlier in connection with Measure 2 after completion of the damping, i.e, after the tone volume envelope level has decreased below a predetermined level. Conversely, the damping may be performed on the primary tone generator register after the tone generator register to be used for the tone generating channel is changed from the primary to the secondary. As explained earlier in connection with step S34 of FIG. 10, in the case where the control parameters, note-on event data and note-on event occurrence time are stored into the secondary tone generator register, a reservation is made, in the reservation area of the primary tone generator register, for damping at particular timing corresponding to the occurrence time stored in register TM. Accordingly, once the timing corresponding to the occurrence time stored in register TM arrives, the tone generating processing using the secondary tone generator register will be commenced after the damping.

After step S58, the CPU 3 loops back to step S55 to repeat the operations at and after step S55.

If answered in the negative at step S56, i.e., no reservation has been detected, or once the determination has become negative due to the operations of steps S57 and S58, the tone generating processing is executed at step S59, in the channel designated by register i, for the period from the start pointer sp to the current time GT. This completes the writing of tone data into the tone forming area for the quantity SR previously set in the output buffer at step S52.

Then, at step S60, a determination is made as to whether the tone generating processing has been completed for all of the tone generating channels having been set at step S53. If answered in the negative at step S60, the channel number of the tone generating channel given the next place in the calculating order is stored into register i, and start pointer sp is set to point to the input time ST, at step S61. Then, the CPU 3 loops back to step S55 to repeat the operations at and after step S55. If, on the other hand, answered in the affirmative at step S60, or once the determination has become affirmative due to execution of the operations at and after step S55, the CPU 3 terminates the tone generating processing and moves on to step S62. In the above-mentioned manner, tone data obtained by accumulating the tone data of the individual tone generating channels (with or without desired effects imparted thereto) is accumulatively written into the tone forming area, for the quantity SR, of the output buffer. If the number of the available tone generating channels ascertained by the CPU 3 is smaller than the number of the assigned tone generating channels, the number of tone generating channels to be used for simultaneously sounding tones is reduced by omitting the tone generating processing for one or more tone generating channels given later places in the calculating order.

At next step S63, the start time ST added with the quantity-to-be-formed SR is set as new time ST. This new time ST is used as a calculation starting point for next execution of "tone generator processing I". After this, at step S64, the magnitude of the tone volume level for the tone generating channel corresponding to the current note-off event is lowered to zero in a gradual manner. At next step S65, a determination is made as to whether or not formation of the "predetermined number of tone data to be written in one output buffer" has been completed. If answered in the negative at step S65, the CPU 3 returns to the main routine. Once the determination becomes affirmative at step S65, the output buffer is decoupled from the other output buffers that are coupled thereto in "tone generator processing II" as will be later described, and its reproduction is reserved in the output device at step S66. After this, the CPU 3 returns to the main routine. The operation of step S66 corresponds to outputting, to the OS's second interface IF2 ("WAVE out API"), tone data formed by the software tone generator SSM in FIG. 1 or 2.

As modifications of the operations of steps S50 and S51, the result of the subtraction "GT−ST" may be directly set as the quantity SR. In such a case, if the tone generator section is not activated due to a failure of generation of the internal interrupt signal at any of the predetermined points, all tone data left-unformed at that time are formed at a next one of the points when the internal interrupt signal is actually generated, as in the FIG. 5 example of Measure 1. Therefore, even when the internal interrupt signal (activating instruction) is not generated at some of the predetermined points in one frame, the "predetermined number of tone data to be written in one output buffer" can be efficiently formed within the same frame only by the operations executed at another one of the points when the internal interrupt signal is actually generated. This arrangement reliably avoids an unwanted hindrance to the tone generation. As previously mentioned in connection with Measure 1, the left-unformed tone data may be formed in a distributed manner at a plurality of later times when the internal interrupt signal is actually generated as in the FIG. 6 example, or may be formed progressively by the end of the last activating time in the same frame.

Further, as a modification of the operation at step 53, the number of the tone generating channels may be determined in the following manner. First, on the basis of a calculating time necessary for forming the quantity SR of tone data in a given tone generating channel and a current available calculating time EJ (i.e., time obtained by subtracting a calculation starting point KJ when the current internal interrupt signal has been actually generated, from a calculation ending point SJ when the internal interrupt signal is to be generated next), it is ascertained how many of the tone generating channels are available to form the quantity SR of tone data. If the number of the available tone generating channels ascertained by the CPU 3 is not smaller than the number of the tone generating channels assigned in the note-on event process, the number of the assigned tone generating channels is directly set as the channels to be used for the tone data formation. If, on the other hand, the number of the available tone generating channels ascertained by the CPU 3 is smaller than the number of the assigned tone generating channels, the number of the available tone generating channels is set as the channels to be used for the tone data formation. Namely, as previously explained in connection with Measure 1, the formation of the "predetermined number of tone data to be written in one output buffer" is secured by reducing the number of the channels to be used for the tone data formation.

Referring back to step S5 of FIG. 8, if triggering factor 3 (i.e., detection of a processing request from the output device) has occurred, the CPU 3 executes "tone generator processing II" at step S10 and goes to step S11 in order to visually present predetermined conditions on the panel screen. Then, the CPU 3 loops back to step S3 to repeat the operations at and after step 3.

Tone generator processing II also forms part of the tone generator section and is executed in response to a request generated by activating the output device (i.e., an external interrupt process by the DMA controller 11). This tone generator processing II corresponds to processing of FIG. 1 or 2 that relates to tone data transfer from the software tone generator SSM to the second interface IF2 ("WAVE out API").

Figure 13:
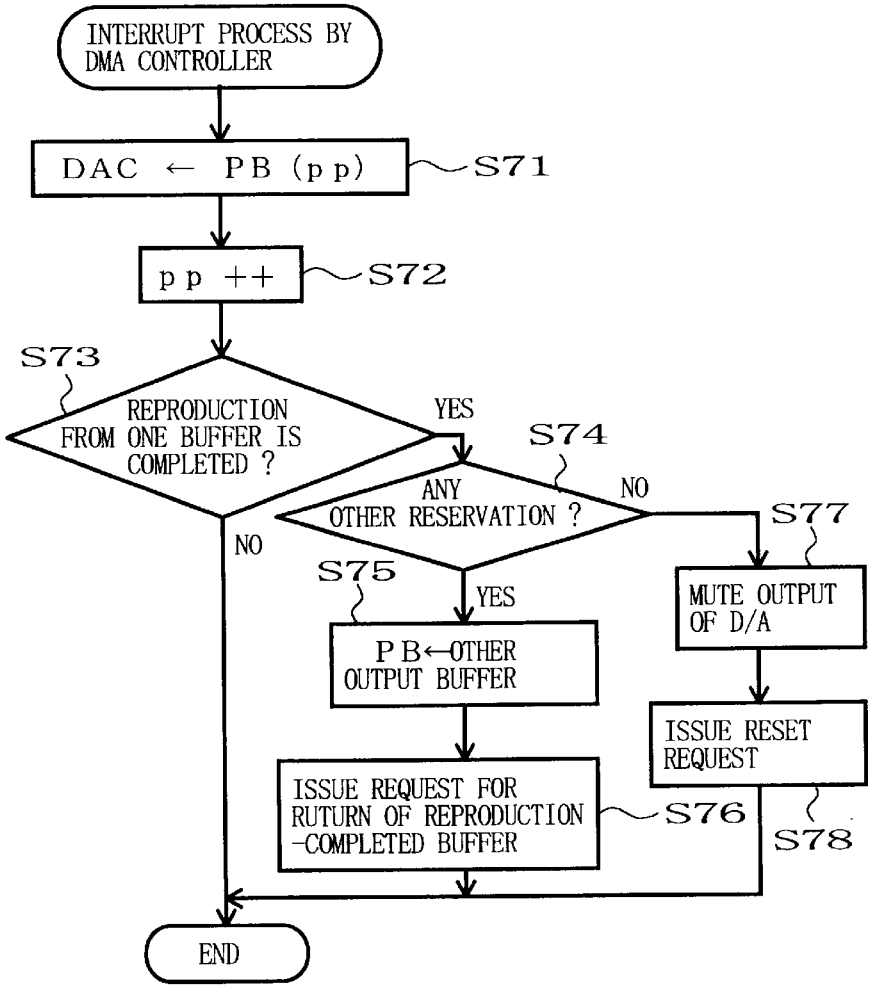
FIG. 13 is a flowchart illustrating an example of an external interrupt process carried out by a DMA controller of FIG. 3.

FIG. 13 is a flowchart of the external interrupt process carried out by the DMA controller 11 each time one sample of tone data is sent to the D/A converter 12, i.e., at a reproduction sampling frequency of the D/A converter 12. By virtue of this external interrupt process, tone data for one frame stored in the output buffer are read out, one sample per reproduction sampling cycle, from the output buffer and supplied to the D/A converter 12. This corresponds to the processing of the output device in FIG. 1 or 2. More specifically, this corresponds to the processing of the output device where it receives the tone data from the software tone generator SSM via the second interface IF2 ("WAVE out API") and then outputs them to the external hardware or D/A converter 12.

First step S71 in the external interrupt process supplies the D/A converter 12 with one sample of tone data that is pointed to by pointer pp and being currently read out from one of the reserved output buffers pointed to by buffer pointer PB. Then, the pointer pp is incremented by one at step S72, and it is determined at step S73 whether or not all the tone data in the output buffer have been completely supplied to the D/A converter 12, i.e., whether the necessary reproduction process has been completed for the output buffer. If the reproduction process has not been completed for the output buffer, the process returns to the main routine.

If, on the other hand, the reproduction process has been completed for the output buffer as determined at step S73, a further determination is made at step S74 as to whether any other output buffer is reserved for reproduction. This corresponds to the operation of the output device accessing the second interface IF2 ("WAVE out API") via the OS, i.e., operation involving the use of the OS.

Even when no other output buffer, having written therein tone data formed by the tone generator, is reserved due to the fact that the activation of the tone generator section is delayed by an influence of some other processing, an affirmative determination results at step S74 until the reproduction from all the already-reserved output buffers (those reserved in the initialization of FIG. 9 or in "tone generator processing I") is completed. With such an affirmative determination at step S74, the DMA controller 11 moves on to step S75 in order to set the buffer pointer PB to point to the other output buffer. As explained earlier in connection with Measure 3, this arrangement can expand such a tolerable range of time delay in activating the tone generating processing which can avoid an unwanted break in a stream of generated tones. At step S76 following step S75, a request is issued for returning to "tone generator processing II" the output buffer for which the reproduction of the tone data has been completed (reproduction-completed output buffer). Then, the process returns to the main routine.

If the activation of the tone generator section is greatly delayed, there may arise a situation where no output buffer, having written therein tone data formed by the tone generator, is reserved even in a particular frame where the reproduction from all the reserved output buffers has been completed. In such a case, a negative determination results at step S74, so that the DMA controller 11 branches to step S77 to mute output signals of the D/A converter 12 so as to prevent noise sound. At next step S78, a reset request is issued to "tone generator processing II" for resetting the tone generation. Then, the process returns.

Figure 14:
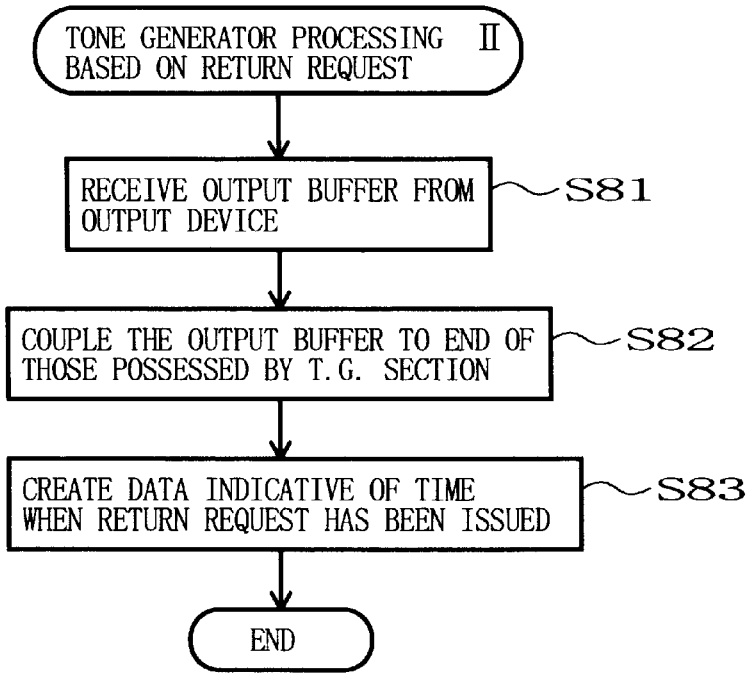
FIG. 14 is a flowchart of an example of tone generator processing II of FIG. 2 executed by the CPU on the basis of a return request issued from the DMA controller.

FIG. 14 is a flowchart of an example of "tone generator processing II" executed on the basis of the return request issued from the output device (step S76 of FIG. 13). The CPU 3 receives the output buffer returned from the output device at step S81, and then at step S82, it couples the returned output buffer to the end of the other output buffers already possessed by the tone generator section after clearing the returned output buffer. This coupling results in virtually linking together the output buffers in a series so as to treat them as a single larger buffer. This eliminates the need to provide these output buffers in physically neighboring areas of the RAM 5. At next step S83, data indicative of the time when the return request has been issued is created, so as to adjust the operation of the tone generator section by ascertaining presence or absence of a difference in operational timing between the tone generator section and the output device. After step S83, the CPU 3 returns to the main routine.

Figure 15:
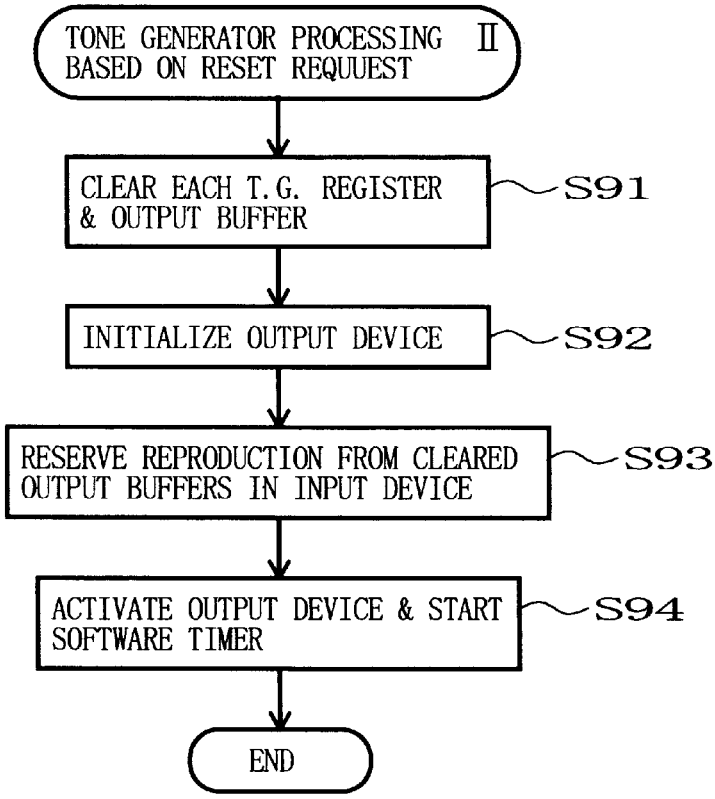
FIG. 15 is a flowchart of an example of tone generator processing II executed by the CPU on the basis of a reset request issued from the DMA controller.

FIG. 15 is a flowchart of an example of "tone generator processing II" executed by the CPU 3 on the basis of the reset request issued from the output device (step S78 of FIG. 13). First, at step S91, the CPU 3 clears all the data from the tone generator register for each of the tone generating channels and from the output buffers in the RAM 5. Then, as at steps S23 to S25 of the initialization process of FIG. 9, the output device is initialized at step S92, the four output buffers cleared at step S91 are again reserved for reproduction at step S93, and the output device is activated and the software timer is started at step S94. Then, the CPU 3 returns to the main routine.

In "tone generator processing II" based on the reset request, when no output buffer is reserved in the output device, the tone generation having been executed so far in the tone generator section is discontinued compulsorily and reproduction from the cleared output buffer is reserved again in the output device, as explained earlier in connection with Measure 4. Then, new tone generation is commenced by activating the tone generator section on the basis of another MIDI message supplied thereafter. Thus, even when the reproduction reservation is not made in time and a temporary disorder is caused in the tone generation, stable tone generating operation can be promptly restored and hence unwanted noise can be minimized.

Referring back to step S5 of FIG. 8, if it is determined triggering factor 4 has occurred, the CPU 3 executes a process responsive to the detected request, such as a process responsive to an input event on the panel screen of the display 9 or to a command input event on the keyboard 8, at step S12. Then, other information corresponding to the process is visually presented on the panel screen at step S13. After this, the CPU 3 loops back to step S3 to repeat the operations at and after step 3.

Finally, if triggering factor 5 (i.e., detection of a main routine ending command on the keyboard 8) has occurred, the CPU 3 executes a predetermined process to terminate the main routine at step S14, causes the panel screen to disappear from the display 9 at step S15 and then returns to the main routine.

In the event that two or more of the above-mentioned triggering factors have simultaneously occurred as determined at step S5, the operations at and after step S5 are executed, for example, in ascending order of the factor numbers (i.e., from triggering factor 1 to triggering factor 5), except that triggering factors 2 and 3 have equal priority. Steps S3 to S5 virtually represent task management in pseudo multitask processing; however, in effect, when a certain process is being executed on the basis of occurrence of any of the triggering factors, the process may be discontinued, by occurrence of another triggering factor of higher priority, to execute another process. For example, when "tone generator processing I" is being executed in response to occurrence of triggering factor 2, the MIDI process may be executed by interruption due to occurrence of triggering factor 1.

For example, if triggering factor 4 or triggering factor 5 occurs while tone generator processing I is being executed in response to occurrence of triggering factor 2 of higher priority, the activation responsive to triggering factor 4 or triggering factor 5 must be waited until termination of one execution of tone generator processing I responsive to triggering factor 2. However, by appropriately determining the quantity-to-be-formed SR per activation as a function of the delay amount OR in accordance with a proper function as shown in FIG. 19 or 20, one execution of tone generator processing I responsive to triggering factor 2 can be prevented from taking too much processing time, so that it is possible to significantly reduce the possibility of the processing responsive to lower priority being disturbed.

A description will be given below about an embodiment corresponding to the system configuration of FIG. 2.

In the case where the system configuration of FIG. 2 is employed, the software tone generator module SSM may be based on the same programs as described in FIGS. 8 to 15, and the same arrangements described above in relation to FIGS. 16, 19 to 21 may be applied. Of course, the arrangements described above in relation to FIGS. 17 and 18 are not applicable to this case. Further, in the case where the system configuration of FIG. 2 is employed, the manner in which the triggering factors are checked at step S3 of FIG. 8 is different from the foregoing. Namely, in this case, occurrence of the following triggering factors is checked:

Triggering factor 1: Supply of a MIDI message via the "MIDI API" interface (e.g., supply of a MIDI interface from the application software APS1 (FIG. 2);

Triggering factor 2: Generation, by the software timer, of an internal interrupt signal activating the tone generator section;

Triggering factor 3: Detection of a processing request from the output device;

Triggering factor 4: Detection of another request such as an input event on the panel screen of the display 9 or a command input event on the keyboard 8 (excluding a main routine ending command); and Triggering factor 5: Detection of an input event of a main routine ending command on the keyboard 8.

Triggering factor 2 to triggering factor 5 are the same as the counterparts in the case where the system of FIG. 1 is employed, but triggering factor 1 is different.

As previously noted, in the case where the system configuration of FIG. 2 is employed, the software tone generator module SSM is installed in the operating system and programmed to identify that a MIDI message has been supplied via the first interface IF1 ("MIDI API") of the operating system. Thus, the software tone generator module SSM, which is itself application software, operates as a driver on the OS and receives the MIDI message supplied from other application software APS1 via the first interface IF1 ("MIDI API"). Then, in the above-mentioned manner, the software tone generator module SSM executes the tone data forming operations based on the received MIDI message by the tone generating processing being activated in response to generation of the internal interrupt signals (activating instructions). The resultant formed waveform data are output, frame by frame, via the second interface IF2 ("WAVE out API") of the OS, as mentioned above.

A description will be given below about an embodiment of the present invention corresponding to the system configuration of FIG. 25.

Figure 26:
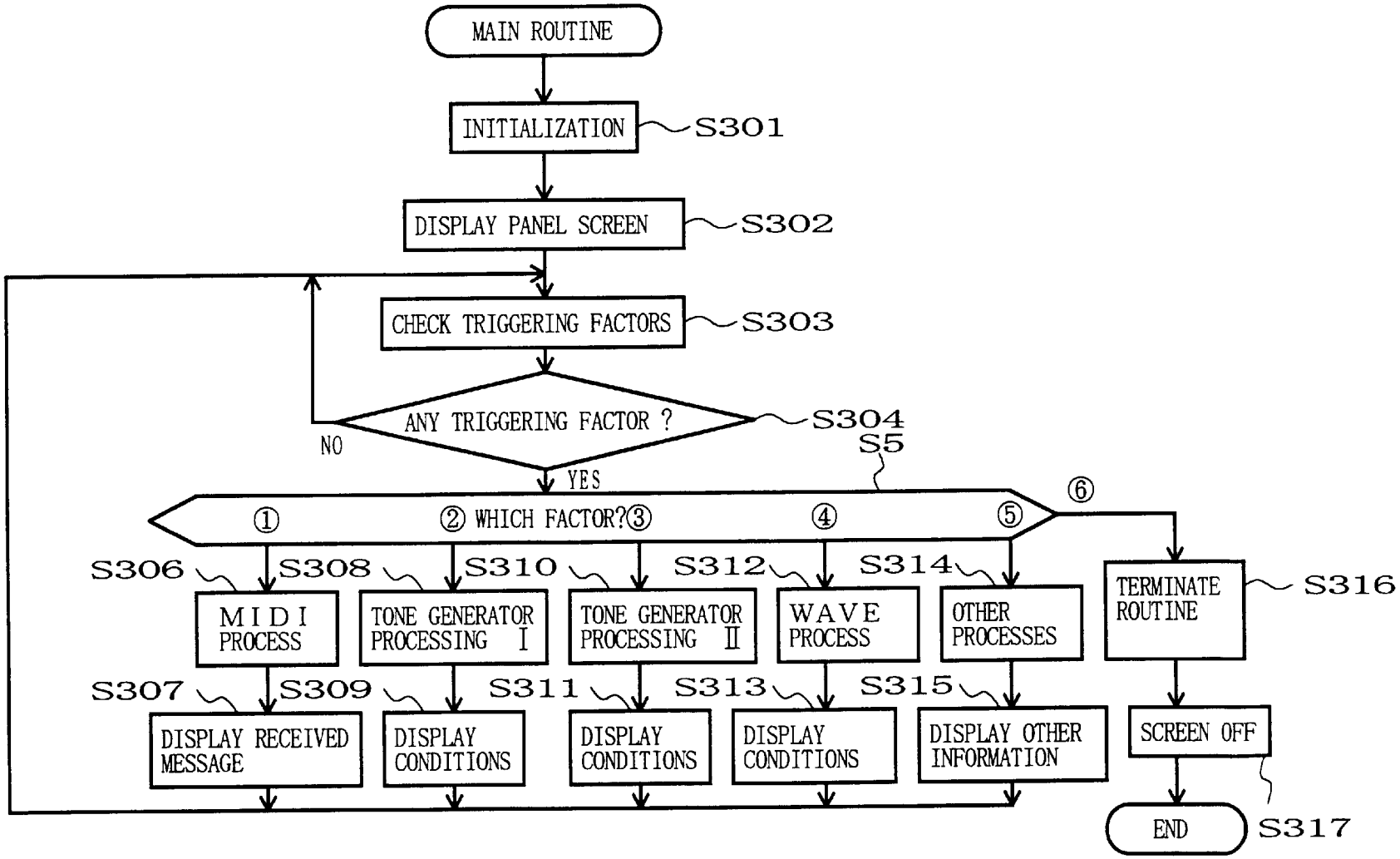
FIG. 26 is a flowchart illustrating an example of a main routine in a sound module program executed by the CPU of FIG. 3 in the software system of FIG. 25.

FIG. 26 is a flowchart illustrating a main routine of a sound module SGM-MM executed by the CPU 3 in a case where the system configuration of FIG. 25 is employed. In the main routine, operations of steps S301 and S302 similar to those of steps S1 and S2 of FIG. 8 are performed, and then the following triggering factors are check at step S303:

Triggering factor 1: Supply of a MIDI message from application software APS1 (FIG. 25) via a first interface IF1 ("MIDI API") interface (FIG. 25);

Triggering factor 2: Generation, by the software timer, of an internal interrupt signal activating the tone generator section;

Triggering factor 3: Detection of a processing request from the output device;

Triggering factor 4: Reception of waveform data from the application software APS1 via a third interface IF3 (FIG. 25);

Triggering factor 5: Detection of another request such as an input event on the panel screen of the display 9 or a command input event on the keyboard 8 (excluding a main routine ending command); and Triggering factor 6: Detection of an input event of a main routine ending command on the keyboard 8.

Triggering factors 1, 2, 3, 5 and 6 above are the same as triggering factors 1, 2, 3, 4 and 5, respectively, that are checked at step S3 of FIG. 8 in the case where the system configuration of FIG. 2 is employed, and triggering factor 4 is a new addition in the case where the system configuration of FIG. 25 is employed.

Figure 27:
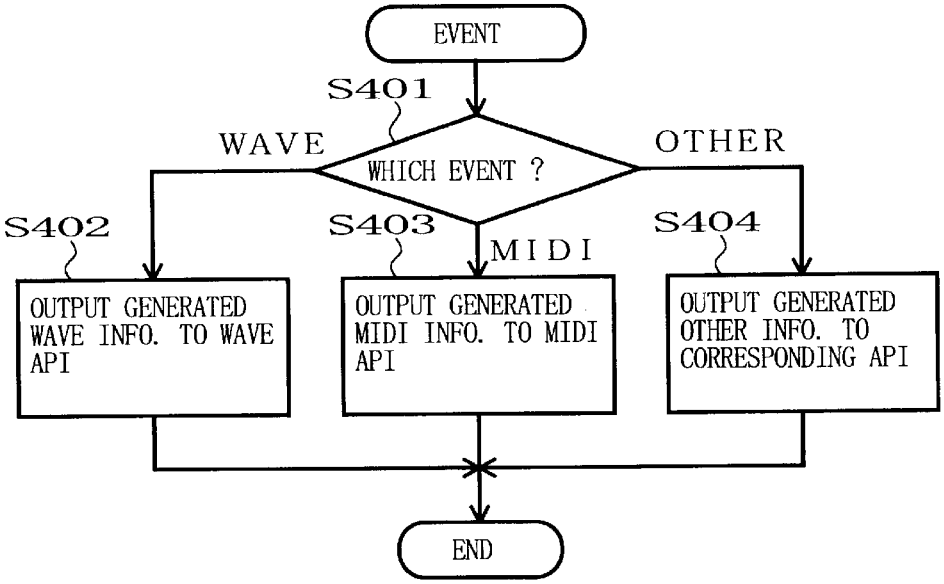
FIG. 27 is a flowchart illustrating an example of processing executed in the software system of FIG. 25 by application software APS1 at event timing of data being reproduced.

FIG. 27 is a flowchart of an exemplary program of the application software ASP1 which give rise to triggering factor 4. This program is activated or triggered at event timing of multimedia data being reproduced, and it is determined at first step S401 which of waveform data generation event, MIDI message generation event and generation event of other sort of information the data is.

If the event is a waveform data generation event as determined at step S401, the program proceeds to step S402 in order to output the generated waveform data to the third interface IF3 (FIG. 25). This gives rise to triggering factor 4. If the event is a MIDI message generation event as determined at step S401, the program proceeds to step S403 in order to output the generated MIDI message to the first interface IF1 ("MIDI API") (FIG. 25). If the event is a generation event of other sort of information (such as image data), the program proceeds to step S404 in order to output the information to an interface API that is possessed by the operating system in correspondence with the sort of the information.

Referring back to FIG. 26, the operations at and after step S304 are similar to the operations at and after step S4 of FIG. 8, except that a WAVE process of step S312 and display of step S313 based on the WAVE process are added and tone generator processing II of step S310 are partly different from the counterpart of step S10 of FIG. 8.

In the event that two or more of the above-mentioned triggering factors have simultaneously occurred as determined at step S305, triggering factor 1 has highest priority and priority of the other triggering factors 2–6 are set to become higher in the order of triggering factor 4, triggering factor 2, triggering factor 5 and triggering factor 6.

Figure 28:
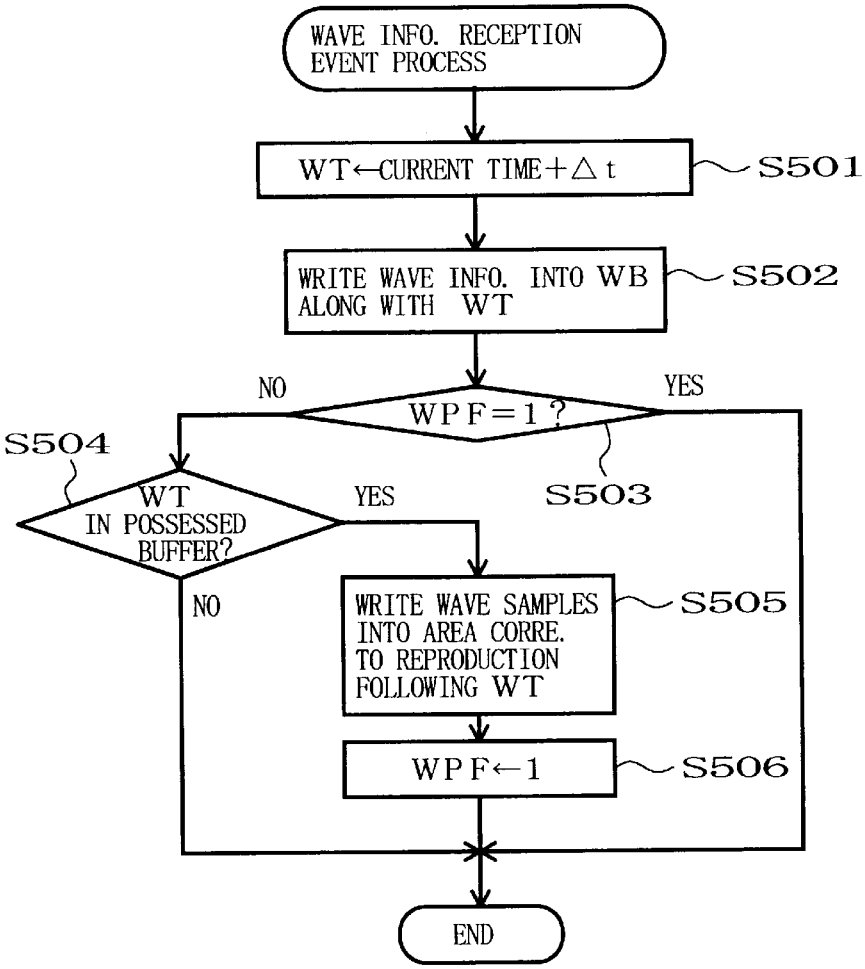
FIG. 28 is a flowchart illustrating an example of a WAVE process of FIG. 26.

FIG. 28 is a flowchart illustrating an example of the WAVE process based on the occurrence of triggering factor 4. At first step S501 in this process, a time period $\Delta t$, from a point when a note-on event is received from the application software APS1 via the first interface IF1 ("MIDI API") of FIG. 25 to a point when tone data formed by tone generator processing I in response to the note-on event is reproduced (a time delay in the tone generation by tone generator processing I is tolerated within the limit of the time period Δt, and the tolerated time delay is of a length corresponding to about four frames), is added to current time and written into a predetermined register WT provided in the RAM 5.

At next step S502, waveform data supplied from the application software APS1 via the third interface IF3 of FIG. 25 are written into a wave buffer WB along with the time data stored in the register WT.

Then, at step S503, a determination is made as to whether a predetermined flag WPF (that indicates a value "1" when waveform data is being written into the output buffer but indicates a value "0" when waveform data is not being written into the output buffer) is at "1" or not. If answered in the affirmative at step S503, the process returns without performing any other operation, but if answered in the negative, the process moves on to step S504 in order to further determine whether the time stored in the register WT falls within a time range when tone data in the currently-possessed output buffer is to be reproduced.

If answered in the affirmative at step S504, the process goes to step S505, where the waveform data stored in the wave buffer WB is written into a specific area of the current output buffer which corresponds to a reproduction time following the time stored in the register WT. Note that because the quantity of waveform data to be written into the wave buffer WB by the WAVE process in response to one waveform data reception event is considerably greater than the quantity of data capable of being written in one output buffer (e.g., the quantity of waveform data corresponds to a reproduction time of about 5 sec), only those of the data in the wave buffer WB corresponding to leading portion of the waveform are written into the output buffer. After step S505, the process moves on to step S506 to change the value of the flag WPF to "1" and then returns to the main routine. If, on the other hand, a negative determination is made at step S504, the process returns to the main routine without performing the operations of steps S505 and S506.

Figure 29:
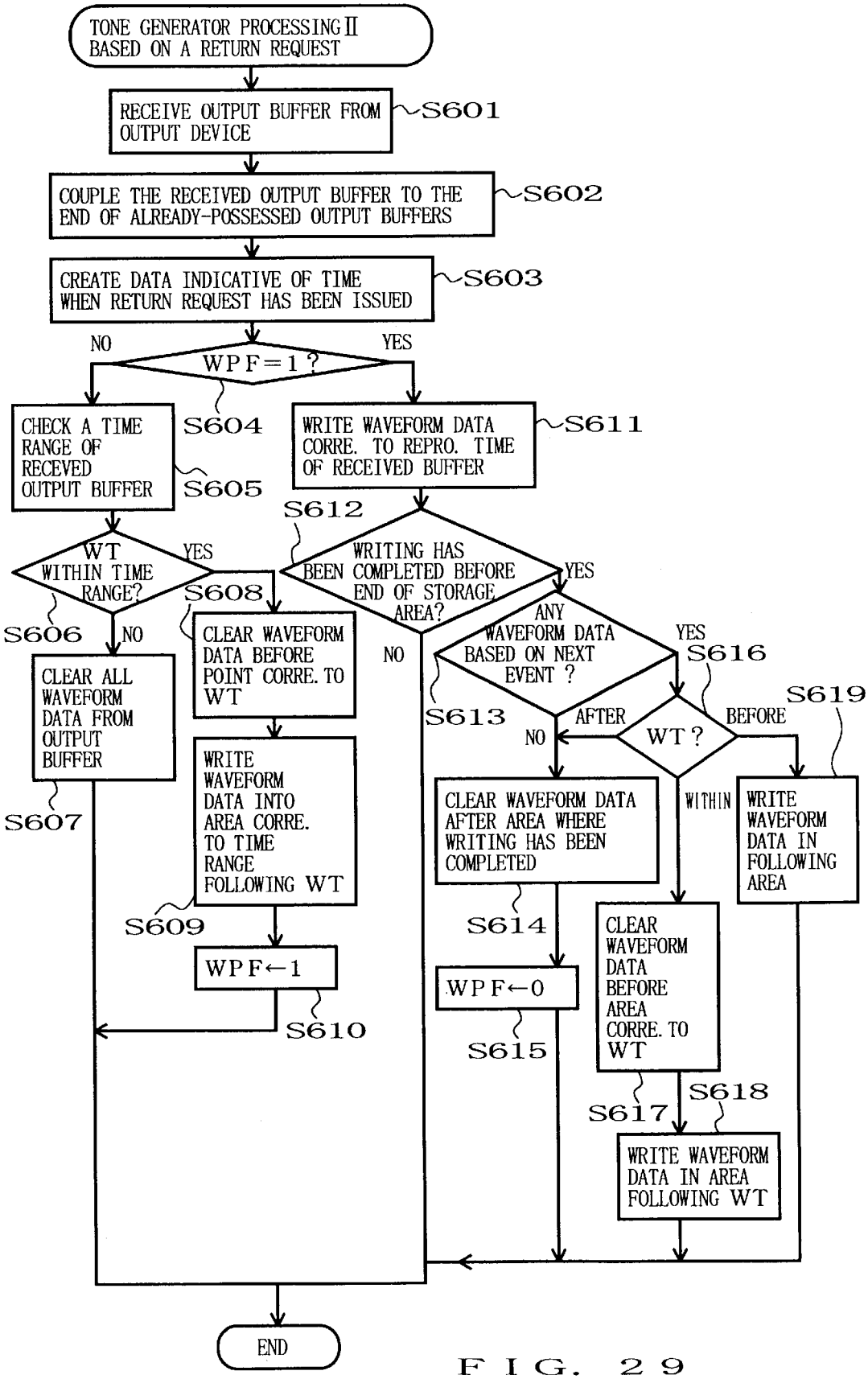
FIG. 29 is a flowchart of an example of tone generator processing II of FIG. 26 executed on the basis of a return request issued from the DMA controller of FIG. 3.

FIG. 29 is a flowchart of an example of tone generator processing II executed in response to a return request from the output device (step S76 of FIG. 76). In this processing, operations of steps S601 to S603 similar to those of steps S81 to S83 of FIG. 14 are first performed, and then it is determined at step S604 whether the flag WPF is at the value "1".

If answered in the negative (i.e, if waveform data is not being written into the output buffer) at step S604, the processing goes to step S605 in order to check a time range in which the output buffer received at step S601 is to be reproduced. At next step S606, a determination is made as to whether the time written in the register WT by the WAVE process falls within the reproduction time range. If answered in the negative at step S606, the processing moves on to step S607 in order to clear all the waveform data from that output buffer and then returns to the main routine. If, on the other hand, answered in the affirmative at step S606, the processing goes to step S608 clear those of the waveform data from the output buffer which are stored therein before the point corresponding to the time written in the register WT. At next step S609, the leading-portion data of the waveform data stored in the wave buffer WB are written into an areas of the output buffer which corresponds to the reproduction time range following the time written in the register WT. After this, the processing moves on to step S610 to change the value of the flag WPF to "1" and then returns to the main routine.

If answered in the affirmative (i.e, if waveform data is being written into the output buffer) at step S604, the processing goes to step S611 in order to write, into the output buffer, those of the waveform data stored in the wave buffer WB which correspond to the reproduction time of the received output buffer (i.e., those following waveform data having so far been written into the output buffer). At next step S612, a determination is made as to whether or not the waveform data writing has been completed before the end of the storage area in the output buffer. With a negative determination, the processing returns to the main routine, while with an affirmative determination, the processing moves on to step S613 in order to determine whet her waveform data based on a next waveform data reception event have been written in the wave buffer WB.

If answered in the negative at step S613, the processing goes to step S614 in order to clear those of the waveform data written in the output buffer after the storage area in which the waveform data writing has been completed at step S611. After this, the processing moves on to step S615 to change the value of the flag WPF to "0" and then returns to the main routine.

If answered in the negative at step S613, the processing goes to step S616 in order to determine whether the time written in the wave buffer WB along with the waveform data in response to the next waveform data reception event is after or within the reproduction time period of the output buffer or before the reproduction time period (i.e., the time has already passed).

If the time is after the reproduction time period of the output buffer as determined at step S616, the processing goes to step S614 in order to perform the above-mentioned operations of steps S614 and S615.

If the time is within the reproduction time period of the output buffer as determined at step S616, the processing goes to step S617 in order to clear those of the waveform data in the output buffer which are located therein before the storage area corresponding to the time written in the register WT. At next step S618, the leading-portion data of the waveform data stored in the wave buffer WB are written into an areas of the output buffer which corresponds to the reproduction time period following the time written in the register WT. After this, the processing returns to the main routine.

Further, if the time is before the reproduction time period of the output buffer as determined at step S616, the processing goes to step S619 in order to write, into an area following the area in which the waveform data writing has been completed at step S611, the leading-portion data of the waveform data stored in the wave buffer WB in response to the next waveform data reception event, and then the processing returns to the main routine.

Figure 12:
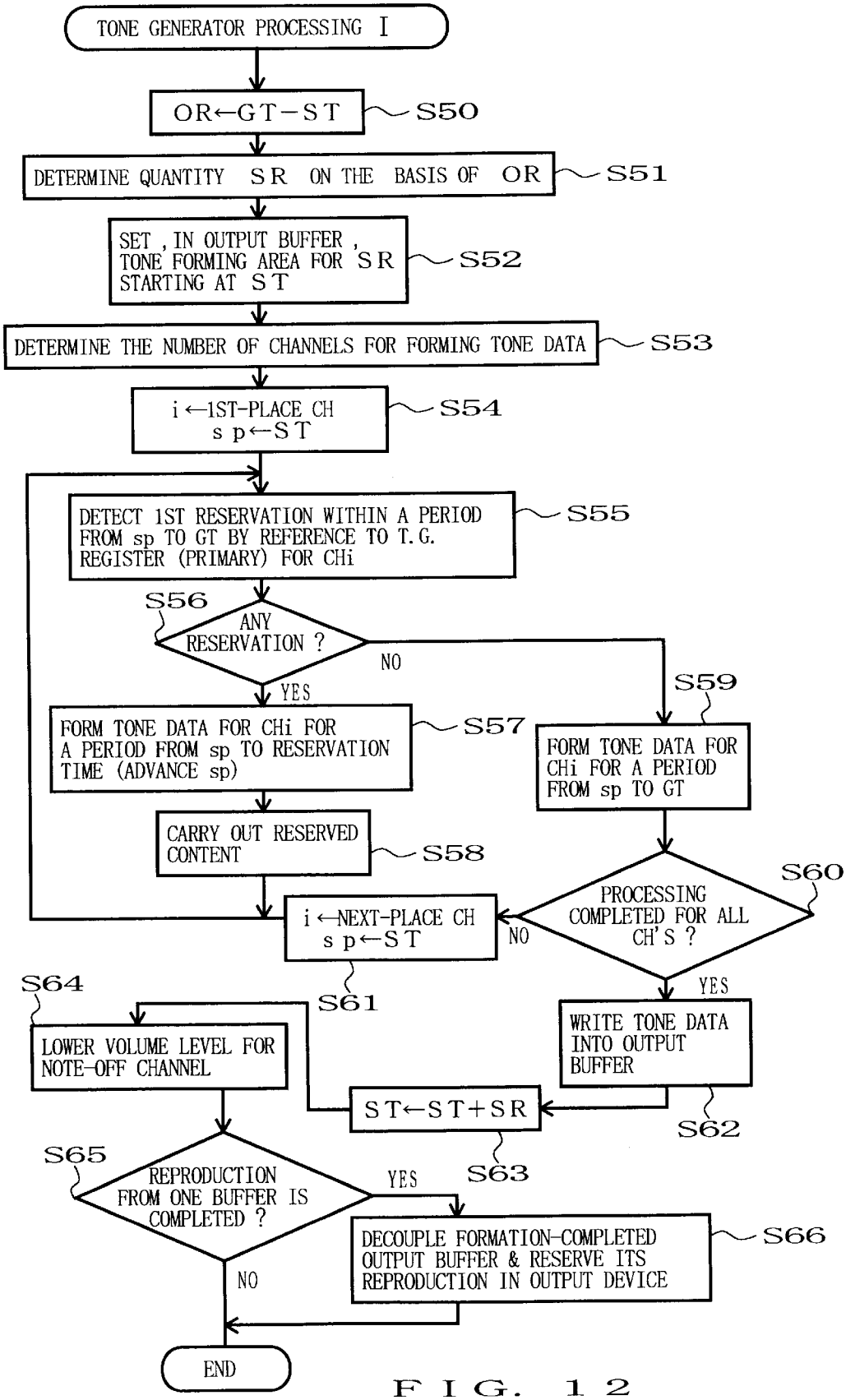
FIG. 12 is a flowchart illustrating an example of tone generator processing I executed by the CPU in the MIDI process of FIG. 8.

By execution of such tone generator processing II, the waveform data supplied from the application software APS1 is written, as an initial value, into an area of the output buffer determined in consideration of the tolerable time delay in the waveform forming processing by tone generator processing I, before the waveform data formed by tone generator processing I is written into the output buffer. Then, in the same tone generator processing I as shown in FIG. 12, the waveform data formed for each of the tone generating channels is accumulatively added to the initial value, so that the waveform data are mixed together in synchronism without being influenced by waveform data forming timing in tone generator processing I.

Figure 30:
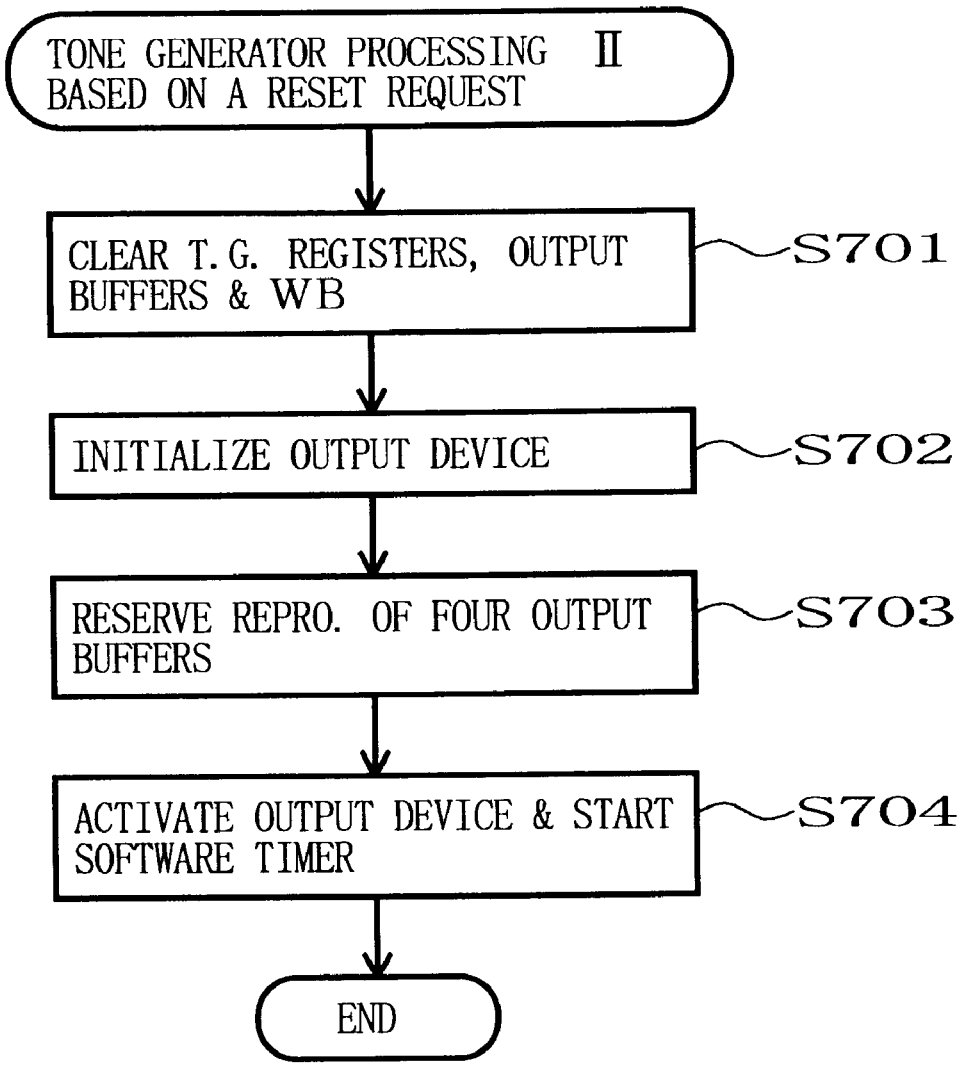
FIG. 30 is a flowchart of an example of tone generator processing II of FIG. 26 executed on the basis of a reset request issued from the DMA controller.

FIG. 30 is a flowchart illustrating an example of "tone generator processing II" executed in response to a reset request from the output device (step S78 of FIG. 13). At step S701, the CPU 3 clears all data from the tone generator registers, output buffers and wave buffer WB. Namely, the waveform data and time data written in the wave buffer WB by the WAVE process in response to each waveform data reception event having occurred so far are all cancelled, so as to start reproduction with newly received waveform data. At following steps S702 and S704, the same operations as at steps S92 to S94 of FIG. 15 are executed. Then, the CPU 3 returns to the main routine.

The above-mentioned operation for writing the waveform data from the application software APS1 into the area of the output buffer as an initial value need not always be performed as part of tone generator processing II executed in response to a reset request from the output device as shown in FIG. 29, but may be performed before formation of waveform data by tone generator processing I. Thus, as another example, the initial value writing may be conducted when the tone forming area is set for the quantity SR at step S52 in tone generator processing I of FIG. 12.

The waveform data generated from the application software APS1 are of different sampling frequencies and may differ in sampling frequency from the waveform data formed in tone generator processing I. Thus, as a preparation for the above-mentioned operation to write the waveform data stored in the wave buffer WB into the output buffer, the waveform data may be subjected to predetermined interpolating or oversampling operations for matching the sampling frequencies.

The above-mentioned reproduction timing adjustment, taking into consideration the tolerable time delay in the waveform forming processing by tone generator processing I, may also be applied to image data and other information generated from the application software APS1.

Thus, in the system configuration of FIG. 25, the waveform data output from the application software APS1 to the third interface IF3 is mixed, in a synchronized fashion, with the waveform data formed by the software tone generator module SSM in response to the note-on event data received via the first interface IF1 ("MIDI API"), and the thus-mixed waveform data is supplied via the second interface IF2 to the operating system. In this way, any time delay in the waveform data formation by the software tone generator module SSM can be appropriately adjusted for matched timing of the waveform data reproduction.

According to Measure 1 employed in the above-described embodiments, the predetermined number of samples of tone data are belatedly formed, for each frame, at some of the subsequent activating times. However, it does not necessarily mean that the formation of the predetermined number of samples of tone data needs to be completed within the same frame. Particularly, these embodiments are designed to reserve a plurality of output buffers, having tone data written therein, for reproduction as shown in FIG. 7, and thus, even when arithmetic formation of the predetermined number of tone data is not completed within one frame, it is possible to perform arithmetic operations to form the remaining tone data in a subsequent frame. For instance, while in the example of FIG. 6, tone data left unformed in one frame due to a failure of internal interrupt signal generation at one or more predetermined points are formed by the end of the last activating time in the same frame, the arithmetic formation of these left-unformed tone data may be carried over to a next frame. For example, all tone data left unformed at four activating times of one frame need not necessarily be formed by the end of the tenth activating time of the same frame as in the example of FIG. 6; instead, only the tone data left unformed at the seventh and eighth activating times may be formed by the end of the tenth activating time of the frame and the arithmetic forming operations of the other tone data left unformed at the ninth and tenth activating times may be carried over to one or more activating times in a subsequent frame when the internal interrupt signal generation occurs. As illustrated in FIG. 16, formation of tone data left unformed in a certain frame may be carried over to a next frame.

Further, according to the above-described embodiments, the control parameters for controlling the tone generator section and data indicative of a note-on event and occurrence time of the event are stored into the tone registers provided separately for the individual tone generating channels in the MIDI process such as the note-on and note-off processes. Rather than being stored into the tone registers for the individual assigned tone generating channels, these control parameters and data may be sequentially written into a single storage area along with respective channel numbers of the channels. In such a case, sequence data will first be created on the basis of supplied MIDI messages, and tone data will be formed on the basis of the sequence data.

Also, according to the above-described embodiments, the output buffer returned from the output device is coupled, through tone generator processing II, to the end of output buffers already possessed by the tone generator section, so that tone generator processing I forms and stores tone data into the intercoupled output buffers, sequentially from one output buffer to another. Alternatively, tone data may be formed and stored separately for each of the output buffers.

Furthermore, while the embodiments have been described above as making a reservation for reproduction from the four output buffers prior to the activation of the tone generator section, the number of the output buffers to be reserved for reproduction may of course be any other value than "four". Also, the number of the output buffers provided in the RAM 5 may be greater than the above-mentioned number of the output buffers to be reserved for reproduction prior to activation of the tone generator section.

Moreover, although the embodiments have been described above as executing all of Measure 1, Measure 2, Measure 3 and Measure 4, the tone generation may be prevented from being hindered by a delay in the activation of the tone generator section even in a case where each of these measures is executed independently of the other measures. Only one of these measures or an appropriate combination of two or three of the measures may be executed.

The above-described embodiments are arranged to store, in the output buffer, waveform data for 400 msec maximum to and then output these waveform data. This arrangement would present a significant inconvenience when the waveform data output loses synchronism with reproduction timing of other information (such as background pictures or words image for karaoke singing) associated with the reproduced music piece, so that it is preferable to take an appropriate counterplan for synchronization. For example, output timing of a MIDI message may be brought ahead of output timing of other information (such as background picture or words image for karaoke) so that the tone generating processing by the software tone generator is executed a little ahead of the other processing; this alternative allows all necessary information to be ultimately output in a synchronized fashion.

In addition, while in the described embodiments the present invention is applied to the software tone generator where the CPU is programmed to execute tone generating processing based on the waveform memory method, the present invention may be applied to a software tone generator where the CPU is programmed to execute tone the generating processing based on another suitable method such as the FM synthesis method.

Moreover, while in the described embodiments the present invention is applied to the software tone generator where the CPU of a personal computer is programmed to execute tone generating processing, the present invention may be applied to a software tone generator where the CPU loaded in a dedicated tone generating device is programmed to execute the tone generating processing. Furthermore, the performance information, on the basis of which waveform data is to be formed, may be in any other form than MIDI form.

Various superior benefits are achieved by the present invention as summarized below.

According to the first aspect of the invention, the fake driver (FMD) is provided so that performance information (e.g., MIDI message) supplied from optional application software (APS1) via the first interface (MIDI API) can be received by the fake driver and then delivered to the application-level software tone generator (SSM). Thus, the software tone generator (SSM), which is itself application software, is allowed to receive the performance information supplied from the other application software (APS1) and then execute the waveform forming processing on the basis of the received performance information. Consequently, the software tone generator can be readily combined with other application software on the OS level and can receive performance information (e.g., MIDI message) supplied via the first interface from the other application software to thereby form waveform data corresponding to the performance information. With such an arrangement, it is possible to increase a range of applications of the software tone generator which is itself application software, and also eliminate the need for a hardware tone generator in a case where desired application software, such as game software, sequencer software or multimedia software, generating performance information (e.g., MIDI message) is to be applied to the operating system of the computer for simple use therewith. As a result, the present invention achieves reduced cost while assuring an increased range of simple applications of the software tone generator.

Further, in another arrangement, the tone generator system further comprises application software (APS1) as a first section for supplying performance information to the first interface (MIDI API) and other application software (APS2) incorporated in the software tone generator (SSM) for exclusive use thereby as a second section for sending performance information to the software tone generator (SSM), so that the generator (SSM) executes both sound waveform data forming on the basis of the performance information supplied from the first section via the first interface and sound waveform data forming on the basis of the performance information supplied directly from the second section. With such an arrangement, it is possible to share the software tone generator between the software incorporated in the software tone generator for exclusive use thereby (APS2) and the other software combined via the operating system with the software tone generator (APS1).

According to the second aspect of the present invention, the software tone generator, which is itself application software (SSM), is installed as a driver in the operating system and programmed to receive the performance information supplied via the first interface (MIDI API). Thus, performance information (e.g., MIDI message) supplied from optional other application software (APS1) via the first interface can be received by the software tone generator via the operating system. With this arrangement as well, the software tone generator, which is itself application software, is allowed to receive the performance information supplied from the other application software and execute the sound waveform data forming on the basis of the received performance information, and generally the same benefits as mentioned in relation to the first aspect can be attained.

Further, according to the third aspect of the present invention, the computer of the tone generator system includes the CPU 3 as a main control section, and this main control section includes a section for generating an activating instruction at one or more of a plurality of predetermined points within a predetermined time period when the program implementing the software tone generator may be actually executed. Thus, the main control section is allowed to generate the activating instruction at one or more of the predetermined points when the program implementing the software tone generator may be actually executed in proper trade-off with current execution states of another program, so that the program implementing the software tone generator and the other program can be executed in a parallel fashion under proper time divisional control. In addition, the tone generator includes an adjusting section for adjusting the sound waveform data forming in such a manner that a predetermined number of samples of waveform data can be formed in total by just the sound waveform data forming being executed in response to the activating instruction actually generated at one or more of the predetermined points. Thus, even when the activating instruction fails to be generated at some of the predetermined points within the period, appropriate control can be made such that the predetermined number of samples of waveform data are formed in total by just the sound waveform data forming being actually executed in response to the activating instruction actually generated at one or more of the predetermined points, to thereby avoid time delays in tone generation. Therefore, the present invention achieves the benefit that the sound waveform data forming and processing based on other software can be executed without any trouble even in the case where these processing is executed in a parallel fashion by the same software tone generator under the control of an operating system not having a full multitask function. Thus, even when the number of activating instructions generated to activate the sound waveform data forming is undesirably reduced due to an influence of the processing based on the other software, appropriate control can be reliably made such that the predetermined number of samples of waveform data are formed completely in total, and thereby unwanted inconveniences, such as time delays in tone generation, are effectively prevented. Because the sound waveform data forming is not executed in fixed time divisions, it is possible to avoid the problem that the processing based on the other software is hindered and delayed by the sound waveform data forming.

In such a case, the adjusting section is arranged in such a manner that at each of the points corresponding to the actually generated activating instruction, it determines a quantity of waveform data to be formed in response to the activating instruction as a function of a "left-unformed" quantity of waveform data that should have been formed up to the point. In this case, the software tone generator is designed to form the determined quantity of waveform data in response to the activating instruction. Thus, by appropriately determining the above-mentioned function, an appropriate number of waveform data to be formed per activating instruction can be determined in proper trade-off with the left-unformed quantity of waveform data that should have been formed. As a result, appropriate control can be reliably made to minimize the possibility that the other processing is hindered by the main control section being occupied by the processing in the software tone generator per activating instruction.

According to the fourth aspect of the present invention, the operating system includes, as an interface for receiving and delivering formed waveform data, the third interface in addition to the second interface, and the sound program, which is installed as a driver in the operating system, forms waveform data on the basis of the performance information received via the first interface, mixes the formed waveform data with the waveform data received via the third interface in a synchronized fashion, and outputs the resultant mixed waveform data to the second interface. By thus mixing the waveform data formed on the basis of the performance information with the waveform data received via the third interface in a synchronized fashion and then outputting the mixed waveform data to the second interface, the time delay in the waveform data formation can be appropriately adjusted for proper matching of the reproduction timing.

Furthermore, with the arrangement that the mixing step accumulatively adds the waveform data formed on the basis of the performance information to the waveform data received via the third interface as an initial value, the waveform data can be mixed together in a synchronized fashion without being influenced by the waveform data formation based on the performance information. As a result, stable reproduction of the waveform data can be effected at appropriately matched timing.

What is claimed is:

1. A tone generator system for forming sound waveform data by use of a computer having installed therein a predetermined operating system and a program for implementing a software tone generator, wherein said operating system includes an application layer and a driver layer, said operating system also including a first interface for receiving performance information on the basis of which waveform data is to be formed and delivering the received performance information to a program installed as a driver for processing the performance information in said operating system, and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, and said tone generator system comprises a fake driver which is installed as said driver for processing the performance information in said operating system and programmed to receive the performance information delivered via said first interface and send the received performance information to said software tone generator, whereby said first interface delivers the received performance information to said fake driver installed as said driver for processing the performance information.

2. A tone generator system as claimed in claim 1 which further comprises first means for supplying performance information to said first interface and second means for sending performance information to said software tone generator, and wherein said software tone generator executes sound waveform data forming on the basis of the performance information supplied from said first means via said first interface and sound waveform data forming on the basis of the performance information supplied directly from said second means.

3. A tone generator system as claimed in claim 1 wherein said computer includes a main control section for executing said program implementing a software tone generator and another program in a parallel fashion, said main control section including means for generating an activating instruction at one or more of a plurality of predetermined points within a predetermined time period when said program implementing a software tone generator may be actually executed, and which further comprises adjusting means for adjusting the sound waveform data forming in such a manner that a predetermined number of samples of waveform data can be formed in total by just the sound waveform data forming processing being actually executed in response to the activating instruction actually generated at one or more of the predetermined points.

4. A tone generator system for forming sound waveform data by use of a computer having installed therein a predetermined operating system and a program for implementing a software tone generator, wherein said operating system includes an application layer and a driver layer, said operating system also including a first interface for receiving performance information on the basis of which waveform data is to be formed and delivering the received performance information to a program installed as a driver for processing the performance information in said operating system, and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, and said software tone generator is installed as said driver for processing the performance information in said operating system and programmed such that said software tone generator receives the performance information delivered via said first interface, said software tone generator executing the waveform data forming processing on the basis of the performance information received via said first interface, whereby said first interface delivers the received performance information to said software tone generator installed as said driver for processing the performance information.

5. A tone generator system as claimed in claim 4 wherein said computer includes a main control section for executing said program implementing a software tone generator and another program in a parallel fashion, said main control section including means for generating an activating instruction at one or more of a plurality of predetermined points within a predetermined time period when said program implementing a software tone generator may be actually executed, and which further comprises adjusting means for adjusting the sound waveform data forming in such a manner that a predetermined number of samples of waveform data can be formed in total by just the sound waveform data forming being actually executed in response to the activating instruction actually generated at one or more of the predetermined points.

6. A tone generator system as claimed in claim 5 wherein at each of the predetermined points when said activating instruction is actually generated, said adjusting means determines a quantity of waveform data to be formed in response to the activating instruction as a function of a left-unformed quantity of waveform data that should have been formed up to said point, and said software tone generator forms the determined quantity of waveform data in response to said activating instruction.

7. A tone generator system for forming sound waveform data by executing a sound program operating under control of a predetermined operating system, wherein said operating system includes an application layer and a driver layer, said operating system also including a first interface for receiving performance information on the basis of which first waveform data is to be formed and delivering the received performance information to a program installed as a driver for processing the performance information in said operating system, a second interface for receiving mixed formed waveform data and delivering the mixed formed waveform data to a waveform outputting program installed as a driver for processing the mixed waveform data in said operating system, and a third interface for receiving formed waveform data and delivering the formed waveform data to a program installed as a driver for processing the mixed waveform data in said operating system, and wherein said sound program is installed as said driver for processing the performance information and said driver for processing the mixed waveform data in said operating system, and said sound program executes a forming step of executing tone generating processing to form the first waveform data on the basis of the performance information received via said first interface, a mixing step of mixing, in a synchronized fashion, the formed waveform data received via said third interface and the first waveform data formed by said forming step to form the mixed waveform data, and an outputting step of outputting to said second interface the mixed waveform data mixed by said mixing step, whereby said first interface delivers the received performance information to said sound program installed as said driver for processing the performance, and said third interface delivers the formed waveform data to said sound program as said driver for processing the mixed waveform data.

8. A tone generator system as claimed in claim 7 wherein said mixing step mixes the waveform data by accumulatively adding the waveform data formed by said forming step to the waveform data received via said third interface, with the waveform data formed by said forming step used as an initial value.

9. A method of forming sound waveform data by use of a computer having installed therein a predetermined operating system and a program for implementing a software tone generator, wherein said operating system includes an application layer and a driver layer, said operating system including a first interface for receiving performance information on the basis of which waveform data is to be formed and delivering the received performance information to a program installed as a driver for processing the performance information in said operating system and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, said method comprising the steps of:

supplying the desired performance information to said first interface;

receiving the desired performance information from said first interface by means of a program installed as a driver for processing the waveform data in said operating system; and sending the received performance information to said software tone generator so that said tone generator executes the waveform data forming processing to form sound waveform data corresponding to the desired performance information, wherein a fake driver is installed as said driver for processing the performance information in said operating system and programmed to receive the performance information delivered via said first interface and send the received performance information to said software tone generator, whereby said first interface delivers the received performance information to said fake driver installed as said driver for processing the performance information.

10. A method of forming sound waveform data by use of a computer having installed therein a predetermined operating system and a program for implementing a software tone generator, wherein said operating system includes an application layer and a driver layer, said operating system including a first interface for receiving performance information on the basis of which waveform data is to be formed and delivering the received performance information to a program installed as a driver for processing the performance information in said operating system and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, said method comprising the steps of:

installing said program for implementing a software tone generator, as a driver in said operating system; and supplying desired performance information to said first interface, said software tone generator receiving the desired performance information from said first interface so as to execute the waveform data forming processing to form sound waveform data corresponding to the desired performance information, said software tone generator is installed as said driver for processing the performance information in said operating system and programmed such that said software tone generator receives the performance information delivered via said first interface, said software tone generator executing the waveform data forming processing on the basis of the performance information received via said first interface, whereby said first interface delivers the received performance information to said software tone generator installed as said driver for processing the performance information.

11. A method of forming sound waveform data by executing a sound program operating under control of a predetermined operating system, said operating system includes an application layer and a driver layer, said operating system also including a first interface for receiving performance information on the basis of which first waveform data is to be formed and delivering the received performance information to a program installed as a driver for processing the performance information in said operating system, a second interface for receiving mixed formed waveform data and delivering the mixed formed waveform data to a waveform outputting program installed as a driver for processing the mixed waveform data in said operating system, and a third interface for receiving formed waveform data and delivering the formed waveform data to a program installed as a driver for processing the mixed waveform data in said operating system, said method comprising the steps of:

installing said sound program as a driver in said operating system;

supplying desired performance information to said first interface, said sound program receiving the desired performance information from said first interface, so as to execute waveform data forming processing to form first waveform data corresponding to the desired performance information; and supplying said formed waveform data to said third interface, said sound program receiving the formed waveform data from said third interface and mixing said first waveform data and said formed waveform data to form mixed waveform data and supplying the mixed waveform data to said second interface, wherein said sound program is installed as said driver for processing the performance information and said driver for processing the mixed waveform data in said operating system, and said sound program executes an outputting step of outputting to said second interface the mixed waveform data mixed by said mixing step, whereby said first interface delivers the received performance information to said sound program installed as said driver for processing the performance, and said third interface delivers the formed waveform data to said sound program as said driver for processing the mixed waveform data.

12. A machine-readable recording medium containing a group of instructions to cause said machine to implement a method of forming sound waveform data by use of a computer having installed therein a predetermined operating system and a program for implementing a software tone generator, wherein said operating system includes an application layer and a driver layer, said operating system including a first interface for receiving performance information on the basis of which waveform data is to be formed and delivering the received performance information to a program installed as a driver for processing the performance information in said operating system and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, said method comprising the steps of:

supplying the desired performance information to said first interface;

receiving the desired performance information from said first interface by means of a program installed as a driver for processing the waveform data in said operating system; and sending the received performance information to said software tone generator so that said tone generator executes the waveform data forming processing to form sound waveform data corresponding to the desired performance information, wherein a fake driver is installed as said driver for processing the performance information in said operating system and programmed to receive the performance information delivered via said first interface and send the received performance information to said software tone generator, whereby said first interface delivers the received performance information to said fake driver installed as said driver for processing the performance information.

13. A machine-readable recording medium containing a group of instructions to cause said machine to implement a method of forming sound waveform data by use of a computer having installed therein a predetermined operating system and a program for implementing a software tone generator, wherein said operating system includes an application layer and a driver layer, said operating system including a first interface for receiving performance information on the basis of which waveform data is to be formed and delivering the received performance information to a program installed as a driver for processing the performance information in said operating system and a second interface for receiving formed waveform data and delivering the received formed waveform data to a waveform outputting program installed as a driver for processing the waveform data in said operating system, said program for processing the performance information and said waveform outputting program being run in said driver layer of said operation system, said software tone generator is application-level software which is run in said application layer of said operating system and executes sound waveform data forming processing to form waveform data on the basis of the performance information and outputs the formed waveform data via said second interface, said method comprising the steps of:

installing said program for implementing a software tone generator, as a driver in said operating system; and supplying desired performance information to said first interface, said software tone generator receiving the desired performance information from said first interface so as to execute the waveform data forming processing to form sound waveform data corresponding to the desired performance information, said software tone generator is installed as said driver for processing the performance information in said operating system and programmed such that said software tone generator receives the performance information delivered via said first interface, said software tone generator executing the waveform data forming processing on the basis of the performance information received via said first interface, whereby said first interface delivers the received performance information to said software tone generator installed as said driver for processing the performance information.

14. A machine-readable recording medium containing a group of instructions to cause said machine to implement a method of forming sound waveform data by executing a sound program operating under control of a predetermined operating system, said operating system includes an application layer and a driver layer, said operating system also including a first interface for receiving performance information on the basis of which first waveform data is to be formed and delivering the received performance information to a program installed as a driver for processing the performance information in said operating system, a second interface for receiving mixed formed waveform data and delivering the mixed formed waveform data to a waveform outputting program installed as a driver for processing the mixed waveform data in said operating system, and a third interface for receiving formed waveform data and delivering the formed waveform data to a program installed as a driver for processing the mixed waveform data in said operating system, said method comprising the steps of:

installing said sound program as a driver in said operating system;

supplying desired performance information to said first interface, said sound program receiving the desired performance information from said first interface, so as to execute waveform data forming processing to form first waveform data corresponding to the desired performance information; and supplying said formed waveform data to said third interface, said sound program receiving the formed waveform data from said third interface and mixing said first waveform data and said formed waveform data to form mixed waveform data and supplying the mixed waveform data to said second interface, wherein said sound program is installed as said driver for processing the performance information and said driver for processing the mixed waveform data in said operating system, and said sound program executes an outputting step of outputting to said second interface the mixed waveform data mixed by said mixing step, whereby said first interface delivers the received performance information to said sound program installed as said driver for processing the performance, and said third interface delivers the formed waveform data to said sound program as said driver for processing the mixed waveform data.

* * * * *